US007384213B2

(12) United States Patent
Shreider et al.

(10) Patent No.: US 7,384,213 B2
(45) Date of Patent: Jun. 10, 2008

(54) APPARATUS AND METHOD FOR CONSTRUCTING A CURVILINEAR STRUCTURE IN AN EXCAVATION

(76) Inventors: Vladimir Anatol Shreider, 1401/55 Morehead St., Redfern, NSW, 2016, Sydney, NSW (AU) 2016; Natalia Shreider, 1401/55 Morehead St., Redfern, NSW 2016 AU, Sydney, NSW (AU) 2016

( * ) Notice: Subject to any disclaimer, the term of this patent is extended or adjusted under 35 U.S.C. 154(b) by 458 days.

(21) Appl. No.: 10/651,121

(22) Filed: Aug. 29, 2003

(65) Prior Publication Data

US 2004/0126191 A1 Jul. 1, 2004

(51) Int. Cl.
*F16L 1/028* (2006.01)
*E03F 3/06* (2006.01)
*E02F 5/10* (2006.01)

(52) U.S. Cl. ..... 405/175; 405/180; 37/316; 37/667; 37/742

(58) Field of Classification Search ..... 37/347, 37/366, 367, 380; 405/154.1, 174, 175, 176, 405/178, 180; 172/315, 316, 667, 742
See application file for complete search history.

(56) References Cited

U.S. PATENT DOCUMENTS

| | | | | |
|---|---|---|---|---|
| 966,411 | A * | 8/1910 | Allen | 172/742 |
| 3,140,745 | A * | 7/1964 | Hinkle et al. | 172/292 |
| 3,638,339 | A * | 2/1972 | Vik | 37/367 |
| 3,782,480 | A * | 1/1974 | Schmahl | 172/110 |
| 3,994,139 | A * | 11/1976 | Foik | 405/157 |
| 6,050,009 | A * | 4/2000 | Adamson et al. | 37/367 |

* cited by examiner

*Primary Examiner*—Tara L. Mayo

(57) ABSTRACT

A slit trench-excavating plough has an elongate frame supporting components of the plough, a number of side wall-supporters movable longitudinally, about and laterally relative to the frame, a number of wedge-shaped cutters pivoted laterally relative to the supporters. The cutters can be turned by an underground driver coupled between the cutter and the supporter to control the direction of excavation and steer the apparatus. The supporters can be moved by the drivers and rams coupled between the frame and the supporters simultaneously in opposite directions to advance the apparatus continuously.

41 Claims, 14 Drawing Sheets

3A
3
2
59
54
16
61A
59A
49A
32A
11A 3
6A
5A
4A
54
4B
4

3;5;6
4

3;5;6
11A
2
59A
59
4

3A;5B;6B
3;5;6
2
4

2
3;5;6
4

59A
4
4E
3B
6C
5C
2
16
59

4
59B
54
3;5;6
2
59A
59
61A
11A
6A
5A
3A

3;5;6
3A;5A;6A
2
11A
2A
32A
3B;5B;6B
4

3;5;6
2
2B 16
3C;5C;6C
32A
4
59C
59

2C
16
16A
2
3;5;6
61A
59C
4
3D;5D;6D 59B
59
3 – 6
19D 59
19C 19B
2
1
16

59A
1
2
3–6
59
19A

4A;6A
59A
59
3A;5A
61A
4;6
8;10
61A
7;9
1
8;10
3;5
2A
2
11A

4B;6B
4;6
3B;5B
8;10
3;5
7,9
2B
2
2A

4C;6C
4;6
3C;5C
8;10
3;5
7;9
2C
1
2
16

APPARATUS AND METHOD FOR CONSTRUCTING A CURVILINEAR STRUCTURE IN AN EXCAVATION

CROSS-REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

The present invention relates to apparatuses and methods for constructing an underground curvilinear and narrow horizontally extending structure, an electrical and light-conducting cable and ground water-draining and material-supplying pipeline, and an anchor, foundation, and ground gas and liquid-captating wall in an excavation, a slit and slot trench being formed in the ground.

In constructing the curved underground structures according to a prior art technique, firstly a section of an excavation, a horizontal slit and slot trench is dug in the ground in an intended direction along an intended excavation line up to a predetermined depth and distance by a proper underground-movable excavating means operated to excavate the ground and adapted to make the curvilinear excavation section, and secondly the excavated section is evacuated with movement of the constructing means forward in the horizontal direction, and thirdly a proper material, a length of the cable, drain and supplying pipe, plastic sheet, filter sand, sealing compound is placed into the section.

A well-known apparatus for constructing an underground curvilinear and narrow horizontally extending structure in-place of a trench comprises an elongate constructing means provided generally with an excavation-making means operated to excavate the ground and advance the curvilinear excavation section along the curved excavation line, and an excavation section side walls-supporting means.

There is known a steering means for an apparatus disclosed in U.S. Pat. No. 5,934,833, the steering means mounted securely to a frame member of the chassis for steering the apparatus with the chassis rolling across the ground to allow excavating the curvilinear trench section by turning break the frame member of the chassis about a central vertical hinge disposed between to turn relatively front driving wheels and a rear driven wheel, that is difficult because the steering is carried out while the apparatus advances and the advancing and driving front wheels of the chassis must provide large road-holding capacity. The cantilever constructing means being inserted into the ground and rotated in the ground by forcing with a transporting and travelling chassis along the length of the line so there are significant defects including requirements of large road-engaging and holding and stabilizing mass of the chassis to provide a huge propulsive force and rotary traction for rotary inserting into and moving the constructing means in the ground and create a huge stabilizing moment about a horizontal and transverse axis for the cantilever constructing means, and the difficulties of advancement of the constructing means into the solid ground, especially including boulders, and the necessary very large chassis means through the loose and slippery ground and rough country.

To decrease those huge intended traction and stabilizing moment for the constructing means which must be created by the chassis it is well-known a slit trench digging apparatus disclosed in U.S. Pat. No. 3,638,339 and provided with a disposed vertically slit trenching blade being capable of oscillating about a vertical axis to form a slit trench and expanding reciprocatingly aside to compact the ground of the side walls and widen the trench, so though there are common defects necessiated with forced applying a huge torque to the blade and its cheeks from above the ground level, and large friction resistance by the compacted side walls to the advancement of the blade; as well as utilizing an advanceable and the side walls-supporting shield disclosed in U.S. Pat. No. 3,994,139 and adapted for laying the pipeline into an open trench, where the shield being composed of a set of the longitudinally displaceable elongate cutting and side wall-supporting planks, a frame member for supporting and guiding the planks and ram means for effecting relative movement between the frame member and planks to effect advancement of the trench. In operation, the ram means advance the planks in relation to the frame member so as to excavate a trench, and other ram means for he planks not being advanced are blocked and holding the remainder of the shield, including the frame member, stationary until all of the planks have been advanced, and then the ram means shift the frame member in the advancing direction. Significant defects of those shield and a method of its advancement are, firstly, that the planks and trench, on the one hand, and the frame member and the pipeline, on the other hand, are advanced alternately and interruptible at a lesser mean speed because frequent standing idles; secondly, advancement of the frame member is not secured because stoppages of the advanced planks and firm frictional contact of the planks with the bottom and walls of the trench are not secured, especially in an unstable, clayey, and muddy, and quick, and running watered, and also in a stony ground, and thirdly, the shield is not capable of advancing a curvilinear trench section.

There is also disclosed in U.S. Pat. No. 5,244,315 a barrier wall installation system comprising a chassis means and a slot trench-excavating assembly digging a vertical slot trench of a depth up to sixty feet behind the chassis means. Significant defects of that barrier wall installation system are: firstly, the huge traction force and stabilizing moment must be applied by the chassis; and secondly, the chassis and the slot trencher are not capable of going round an obstacle like a boulder comes suddenly across the trencher in the ground.

There is known to use an excavator disclosed in U.S. Pat. No. 5,685,668 for constructing an underground continuous wall, comprising an extensible and guide post vertically supported by a tiltable frame on a traveling trolley of a chassis and having an endless chain cutter member and agitator. Significant defects of those excavator and method of its advancement are, firstly, the hole drilled in an unstable ground will be quickly collapsed that prevents the excavator to be inserted into the hole; secondly, the cantilever chain cutter member is advanced by a necessary huge traction force while the huge stabilizing moment must be applied by the trolley from above the ground level; thirdly, the excavator is not capable of going round an obstacle like a boulder comes suddenly across the trencher in the ground.

SUMMARY OF THE INVENTION

It is an object of the invention to provide more efficient apparatuses and simple methods for constructing the continuous narrow underground structures such as a curvilinear cable, drain and supplying pipe line, anchor and foundation column and pile, and a curved area-shaped anchor, foundation, drain and impervious stratum and wall in-place of a smooth excavation such as a hole and trench being formed in the unstable ground that includes boulders and rocks and having the side walls being supported by the movable longitudinally and turningly wall-supporting means of constructing means of the apparatuses, for lighten and reliable securing the continuous and steering turning advancement of the excavation, the continuous structure and the non-self-propelled and steered apparatus across a land being difficult to pass through, and around the boulders and rocks discovered ahead of the constructing means, owing a better manoeuvrability of the constructing means and a continuous, directing and increased traction force being applied to the chassis by the constructing means, and exception of stops and idle standing of the constructing means advancing turningly the excavated section and structure and any risk of damage of the structure because the stoppages.

In order to accomplish the object of the invention, the apparatus for constructing an underground curvilinear and narrow structure in an excavation being formed in the ground that includes large and mainly ball-shaped boulders, the apparatus according to the invention comprises: a chassis means supporting a means for constructing the structure and supplying motive power and structure materials to a structure constructing means of the apparatus, the chassis is capable of moving along the length of and stopping at a structure line, the constructing means comprising a frame member for supporting components of the constructing means and a means for making excavated sections to excavate sections ahead of the supporting frame means, the making means is able to force the supporting frame member from its position toward the intended advancing direction and control the direction of the advancement of the excavation, and is adapted to be disposed in working positions and extended into the ground up to a predetermined depth and distance toward and in the intended advancing direction to excavate, and form the side walls of an excavated section being formed along the length of the line to lay the structure materials into the excavated section; and a connecting framework means mounted on the chassis means and adapted to connect the constructing means to the chassis means and to dispose and advance the constructing means in an intended advancing direction, the framework means comprises a carrier member that is forced into engagement with the supporting frame member; where the excavation-making means has the ability to control the direction of the excavated section and comprises excavation-making portions having the ability to control the force and direction of deformation of the working end facial wall of the excavated section at the making means, where the making means is capable of being forced into interaction with the facial wall of the excavated section being formed to urge the constructing means with the frame member in a direction crossing the central longitudinal axis of the excavated section toward the intended advancing direction and has forward-oriented excavation-making portions for forcing the wall in the crossing direction, where the portions are operable to move the constructing means, with the directing and making means, relative to the wall being forced toward the direction by an activating means capable of forcing the portions against the wall, the portions have the ability to control the direction and force of deformation of the facial wall of the excavated section being formed; where the making members and the follower frame member are connected for movement about axes preferably perpendicular to the central longitudinal surfaces of the members and transversal to the direction of advancement of the members with the ability to interact with the walls to urge the members in the lateral direction in formation of the excavated section, where the making portions of the making members are capable of forcing continuously the facial wall in a direction opposite to the diverged advancing direction and operable to move the constructing means toward and in the direction by a drive means that located within the excavated section and capable to move the portions about the axes relative to the frame member, and the portions of the frame member are capable of deforming the ground to form the side walls into a curved surfaces and are operated by the activating means to move the members about the axes in order to move the members along the length of the section; where the making members have forward oriented, angle-shaping portions, the member comprises a drive means located within the excavated section to effect the relative movement about the axes between the directing and making member and the follower frame member; the making members comprise a directing and making wedge-shaped cutter member connected to the frame member for movement about an axis on the central longitudinal surfaces of and transversal to the direction of advancement of the cutter member and the frame member; the making members have the ability to be forced to move about the axis of the frame member and are adapted to urge the frame member to move about the axis of the carrier member, and the portions being capable to be forced to move about the axis of the frame member and operable to move the frame member toward the intended advancing direction by a drive means capable of moving the portions about the axis relative to the frame member; the drive means comprises a means for providing motive power having a longitudinally in the axial direction displaceable output rod and including castellated portions leaning on corresponding castellated bearings of the support frame member for axial longitudinal displacement and engaging screw-shaped splined portions capable of interacting with corresponding engaged screw-shaped splined portions of the making members; the portions are composed of a plurality of cutting and directing sections with the ability to be moved separately and being operable to move about the axis by the separate drive means capable to move each of the sections about the axis separately from the other sections and to fix the sections to be stationary relative to the frame member, the movement of the frame member about the axes is allowable by catch locks of the framework that are adapted to be broken by a buried obstacle of a predetermined size the apparatus comes across in the ground; where the directing and making means is disposed perpendicularly to the road surface and capable of forcing the wall in a direction crossing on the sides of the axis of turning advancement of the excavated section and adapted to urge the chassis means to move about the axis, the carrier member that is disposed remotely from the axis of turning advancement of the chassis means and adapted to urge the chassis means about the axis to follow the constructing means while the excavated section is being advanced so that the direction of the transportation of the chassis means can be controlled.

The apparatus further comprises a plurality of side wall-supporting members that are connected to the frame member for movement about the axis of turning advancement of the excavation and adapted to urge the frame member forward and about the axis relative to the walls to form cylindrically-shaped walls, and a plurality of activating rams means for effecting the relative turning movement between the frame member and the forming members about the axis to effect the turning advancement of the excavation; where the multiple activating means are capable of simultaneously effecting uninterruptible movements together between the frame member and the intended number of the forming members aside of the frame member and stationary relative to the walls at the speed V1, where the speed V1 is equal to the speed of continuous uniform advancement of the frame member in the same direction with the chassis means and alternate and uninterruptible movement in opposite directions between the frame member and each of the forming members alternately approaching the end of the working stroke at preferably the same speeds V2 and distances relative to the frame member, where the speed V2 must be equal to not less than about "$(0.5n-1)\times V1$" in relation to the frame member and "$0.5n\times V1$" in relation to the ground where "n" is the number of the forming members; where the side walls-engaging members have the ability to be expanded and outwardly forced into compressive engagement with the side walls being supported by the member to immobilise the side wall-supporting member relative to the walls; where the frame member is connected to the framework means for movement about a direct axis, and transversal axis, and an axis perpendicular to the road surface; the side wall-engaging members are multistorily disposed and the rams means are capable of moving the constructing means about the axes of the connection the constructing means and the carrier member into intended positions in the ground at speeds according to the locations of each of the members along the length of the frame member; where the directing and making means is disposed perpendicularly to the road surface and capable of forcing the wall in a direction crossing on the sides of the axis of turning advancement of the excavated section and adapted to urge the chassis means to move about the axis, where the carrier member is disposed remotely from the axis of turning advancement of the chassis means and adapted to urge the chassis means about the axis to follow the constructing means while the excavated section is being advanced so that the direction of the transportation of the chassis means can be controlled; and the supporting means is adapted to urge the chassis means forward relative to the side walls being supported and the rams means capable to advance the chassis means relative to the wall-forming and supporting members; and the carrier member is disposed remotely ahead of the axis of turning advancement of the chassis means and adapted to urge the chassis means forward and about the axis to follow the frame member while the excavated section is being advanced so that the chassis means can be steeringly advanced; the carrier member is operated by an activating means that is capable of moving wall-forming and supporting members backward relative to the frame member and by an activating drive means capable of rotating directing and making members relative to the frame member.

The apparatus further comprises the directing and making members and several follower members connected in consecutive order, relative to the advancing direction, for movement about axes preferably perpendicular to the central longitudinal axes of adjacent members with the ability to interact with the walls to urge the members in the lateral direction in the formation of the excavated section, and the portions are capable of deforming the ground to form the side walls with a curvilinear longitudinal axis and are operated by the activating means capable to move the members about the axes in order to move the members along the length of the section; where the front follower member and a next follower member are relatively movable along a direction crossing the central longitudinal surface of the next member toward the intended advancing direction and comprise another follower member, and holding member connected to the next member for radial movement about a front follower member axis on the central longitudinal surfaces of the front member and the next member and crossing the advancing direction and for holding the front member to be oriented in the radial direction about the axis; a second activating means of the constructing means effects the movement between the front member and the next member about the first follower member axis to form the side walls to advance the excavated section; where the directing and making member and the front follower member consist of a plurality of shortened unit means for controlling the direction of the excavation, compressing and forming and supporting the side walls, the unit means are disposed in narrow side-by-narrow side relationship in relation to a direction crossing the advancing direction and along the length of a forward-oriented edge of the next follower member, each of the unit means includes a direction-controlling and excavation-making member that is able to force the facial wall and oppose side wall-deforming and supporting members that are engaged with the walls and movable in a radial direction about the first follower member axis on the central longitudinal surface of the front member and the next member, where the front member is connected to a separate follower member holding member to allow reciprocating movement in the radial directions about the first follower member axis relative to the next member, the movement being caused by an activating means of the unit means, and is capable of moving the holding member about the first axis behind one of the unit means on the central longitudinal surfaces of the front member, the next member, and the holding member and crossing, preferably transversal to the direction of reciprocating movement between the next member and the front member with the ability to be rotated separately by the making member relative to the next member in a diverged in relation to other unit means radial direction to separately form and support the walls and effect movement between the next member and further adjacent follower member about a second follower member axis to effect the turning advancement of the excavated section in a diverged direction and past an obstacle; the holding member is adapted to locate a position of the unit means relative to the next member and is connected to each of the adjacent holding members between by a catch lock that is adapted to be broken by an obstacle of a predetermined size; each of the unit means comprises a drive means for effecting the movement between the making member and the front support member to effect the movement between the making member and the next member about the first follower member axis and the excavated section; where the directing and making members capable of forcing the facial wall in a direction crossing on the sides axes of movable connection of the frame member to the framework means and are adapted to urge the constructing means toward the one side as well as other side about the axes, and the portions being disposed remotely ahead of the axes, and the frame member is adapted to be moved about the axes; where the next member is the frame member connected to the carrier member for turning the chassis means about the centre, the connection is made remotely from and ahead of the centre, the carrier member is adapted to turn the chassis means to follow the adjacent frame member and operated by the activating means of the constructing means that is capable of moving the front member backward to the next member and by an activating means of the constructing means that is capable of moving the making members relative to the front support member, the activating means of the frame member capable of moving the unit means and the constructing means about a transversal axis of the connection the frame member and the carrier member and an axis of curvature of an initial excavated section being advanced into intended working positions for horizontal advancement in the ground at speeds according to the locations of each of the unit means along the length of the frame member and relative to the axis; where the next member is connected to the framework means for movement about a direct axis, the transversal axis, and a vertical axis; where the framework means is adapted to turn the chassis means to follow the adjacent next frame member.

In another aspect, in the underground continuous structure construction method using the apparatus described above, the method according to the invention comprises the following steps: (a) operating an activating means of an apparatus for constructing the excavation, the activating means moves a means for constructing the underground structure with a framework means on a movable chassis means of the apparatus into working positions on an excavation line; (b) operating the activating means to insert the means for directing and making at the working position into the ground to a predetermined depth and distance in the excavation and in an intended advancing direction, so that the means for directing and making forms the section of the excavation along the excavation line, the direction of the excavation diverges from the tangent of the central longitudinal axis of the section and is determined, (c) operating the activating means to insert into and move a supporting frame member of the constructing means in the excavated section along the tangent to cause the directing and making means to excavate the section; (d) operating an activating and drive means of the constructing means to move the directing and making means to force the ground of the facial end working wall of the excavated section at the directing and making means in a direction opposite to the diverged direction to cause to be forced toward the diverged direction and force the frame member to form the side walls at the frame member toward the diverged direction so to advance the excavation in the diverged direction to evacuate the section and materials of the structure to be let into the excavated and evacuated section; where the activating and drive means are located within the section that is formed by forces applied to the walls of the section by the directing and making means and the frame member; stopping the constructing means by the activating means of the apparatus right away when the constructing means accidentally runs against a buried obstacle, and remotely exploring a position, shape, and dimensions of the buried obstacle by a well-known suitable measuring means to determine when to operate the multiple activating means to effect further advancement of the section, and selectively operating the multiple activating means of the apparatus in accordance with results of the measuring means; operating an activating means of the constructing means to move toward and in the diverged direction a means for forming and supporting the side walls, the means for forming and supporting being part of the constructing means, relative to the frame member and turning the frame member relative to the supporting means toward and in the diverged direction; stopping the constructing means by the activating means of the apparatus right away when the constructing means accidentally runs against a buried obstacle, and remotely exploring a position, shape, and dimensions of the buried obstacle by a well-known suitable measuring means to determine when to operate the multiple activating means to effect further advancement of the section, and selectively operating the multiple activating means of the apparatus in accordance with results of the measuring means; (e) operating the activating means of the constructing means to advance a means for forming and supporting the side walls of the excavation about and relative to the axes of the frame member and to stop within the excavated section to form and support the walls, where the means for forming and supporting being part of the constructing means; (f) operating an activating means of the forming and supporting means to move wall-forming and supporting portions of the stopped forming and supporting means outwardly in opposite directions against the walls of the section to form the walls; and (g) operating the activating means of the constructing means to move the frame member about and relative to the axes of the forming and supporting means in the advancing turning direction at a speed, V1, where the speed must be equal to a speed of turning the constructing means in the same direction by the activating means of the chassis means to cause the constructing means to decrease the traction by and the overturning moment about the chassis means, the speed V1 of the continuous uniform turning the frame relative to the forming and supporting means is secured by operating the activating means of the constructing means to effect the alternate uninterruptible turning in the opposite directions between the frame and each of the side walls forming and supporting members, n, with the same preferably distances and speeds, V2, relative to the frame, and V3, relative to the ground, where the speeds must be equal to no less than about $V2=(0.5n-1)\times V1$, and $V3=0.5n\times V1$.

An apparatus for use in constructing an underground continuous horizontally extending narrow structure in an excavation being formed in the ground, the apparatus according to the invention and comprises: an advanceable means for excavating an excavation and supporting the walls thereof, the constructing means being composed of a plurality of longitudinally displaceable side wall-supporting members, frame means for supporting and guiding the members and activating ram means for effecting relative movement between the frame means and the members to effect advancement of the excavation, the wall-supporting members have the ability to be expanded and outwardly forced into compressive engagement with the side walls being supported by the member to immobilize the side wall-supporting member relative to the walls; where the side wall-supporting members have side wall-supporting portions reciprocatingly movable in transversal direction that are capable to compressively engage the walls of the excavated section and are operable to expand the supporting member for immobilizing the member relative to the walls by an activating means capable to outwardly move the portions to engage the walls and move the portions relative to the frame means and the adjacent supporting member; where the multiple activating means are capable of simultaneously effecting uninterruptible movements together between the frame means and the intended number of the members stationary relative to the walls at the speed V1, where the speed V1 is equal to the speed of continuous uniform advancement of the frame means in the same direction with another traction means of the apparatus and alternate and uninteruptible movement in opposite directions between the frame means and each of the members alternately approaching the end of the working stroke of the ram means at preferably the same speeds V2 and distances relative to the frame means where the speed V2 must be equal to not less than about "(0.5n−1)×V1" in relation to the frame means and "0.5n×V1" in relation to the ground where "n" is the number of the members.

A method for use in constructing an underground continuous horizontally extending narrow structure in an excavation being formed in the ground, the method according to the invention and comprising: (a) operating the activating means of the constructing means to advance a means for supporting the side walls of the excavation relative to the frame means which supports and guides the members and to stop within the formed section to support the walls, where the means for supporting being part of the constructing means; (b) operating an activating means of the supporting means to move wall-supporting portions of the stopped supporting means outwardly in opposite directions against and into compressive engagement with the walls of the section to immobilise the supporting means relative to the walls; and (c) operating the activating means of the constructing means to move the frame means relative to the supporting means in the advancing direction at a speed, V1, where the speed must be equal to a speed of movement of the constructing means in the same direction with an another traction means to cause the constructing means to decrease the traction by and the overturning moment about the traction means; where the speed V1 of the continuous uniform movement of the frame means relative to the supporting means is secured by operating the activating means of the constructing means to effect the alternate longitudinal uninterruptible movement in the opposite directions between the frame means and each of "n" side wall supporting members of the supporting means with the same preferably distances and speeds, V2, relative to the frame means, where the speeds must be equal to no less than about V2=(0.5n−1)×V1.

DETAILED DESCRIPTION OF THE INVENTION

Figure 3:
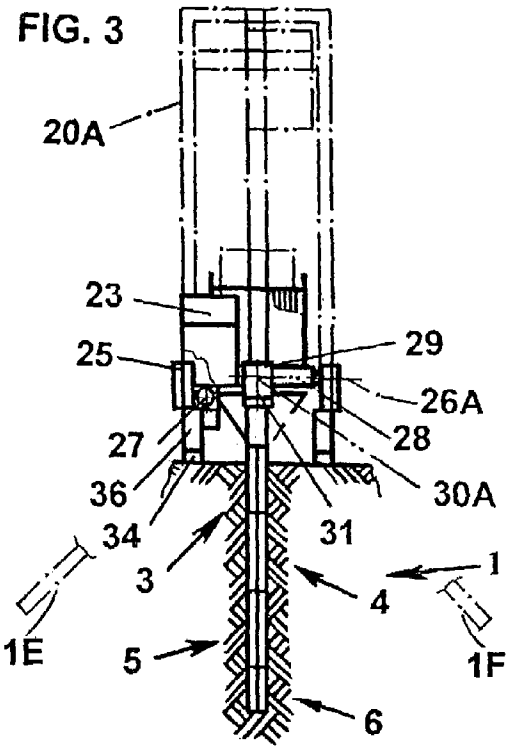
FIG. 3 is a front view of the apparatus in FIG. 1 and FIG. 2.
Figure 1:
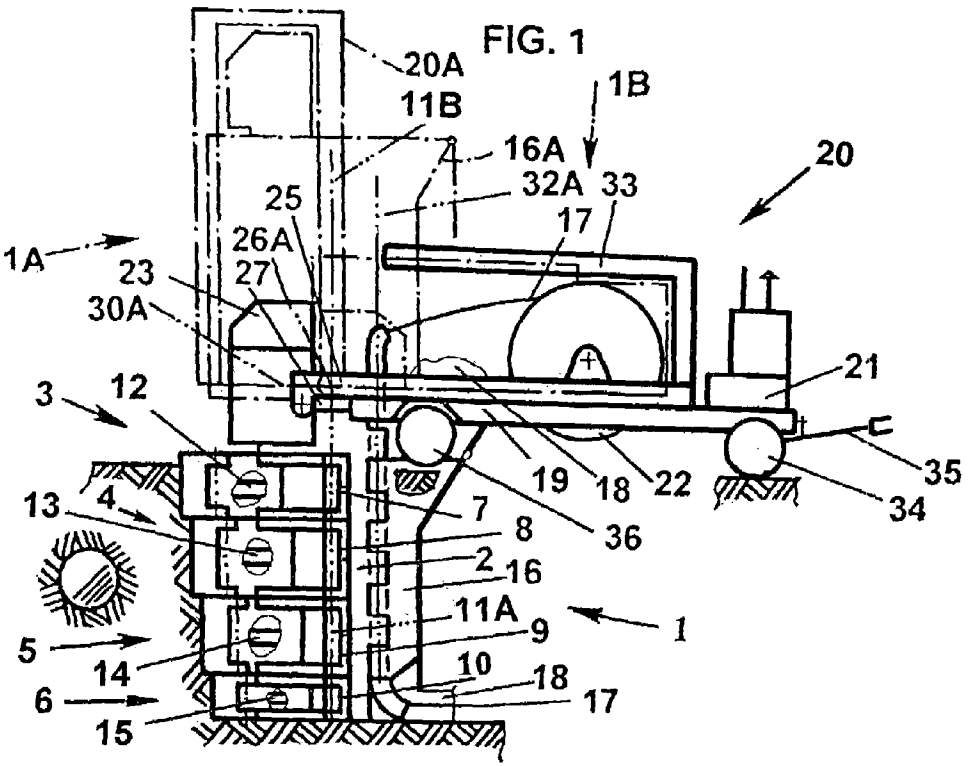
FIG. 1 is a side-view, partly in schematic form of a first preferable embodiment of an apparatus for constructing an underground structure, the apparatus is adapted to construct a horizontal drain pipeline and granular filter in a slit trench of the depth of four meters and the width of 30 centimetres being formed in unstable ground that includes large and mainly ball-shaped boulders, according to the present invention.
Figure 2:
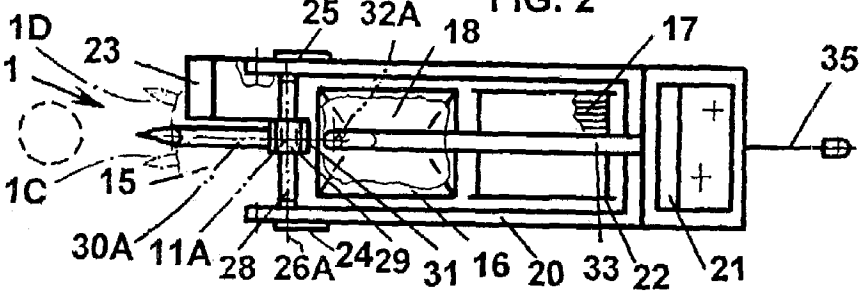
FIG. 2 is a plan view of the apparatus in FIG. 1.

The first embodiment of the apparatus is shown in FIG. 1 to FIG. 3 and comprises an elongate and preferably vertically disposed structure-constructing means 1 for constructing sections of an excavation such as a slit trench and laying into the section being formed the length of a drain pipe and granulated filter material, that includes an elongate frame member 2 for guiding and supporting components of the constructing means 1, a plurality of shortened units means 3,4, 5, and 6 for controlling the direction of the excavation, compressing side walls, forming and supporting the plane-, conical-, and cylindrically-shaped side walls ahead of the frame member 2, the units means 3 to 6 are disposed multistonly in narrow side-by-narrow side relationship ahead, and along the length of, and connected to the frame member 2 for movement toward and in an intended diverged advancing direction crossing the central longitudinal surface of the frame member 2 and adapted to excavate the section, force continuously the working end facial wall of the section being formed in directions opposite of the diverged direction and crossing the tangent of the central longitudinal axis of the section, form the side walls and be forced continuously relative to the facial wall in opposite directions crossing the central longitudinal axis of the units means toward the diverged direction to force continuously the frame member 2 from its position toward the intended diverged advancing direction; holding follower members 7, 8, 9, and 10 for allowing reciprocating movement of each of the units means 3 to 6 in radial directions about a vertical preferably axis 11A common preferably and within the central longitudinal surface of the frame member 2 and the units means 3 to 6 and perpendicular to the ground surface, connected to the frame member 2 for movement about the axis 11A and adapted to hold each of the units means 3 to 6 to be oriented in the radial directions and to locate a position of each of the units means 3 to 6 relative to the frame member 2, an activating means of the units means such as actuating double-acting hydraulic power rams means 12, 13, 14 and 15 connected separately to the frame member 2 and the units means 3 to 6 and capable to move relatively and turningly the units means 3 to 6 and the follower frame member 2 about the axis 11A to advance the curvilinear section; and a next follower hopper member 16 for feeding the length of a drain pipe 17 and filter sand 18 into the section being evacuated by and behind the frame member 2, and a chassis means 19 for supporting and transporting components of the apparatus and supplying materials and power to the constructing means 1 and movable over the ground along the length of the excavation line, a framework means 20 mounted on the chassis means 19 and adapted to connect the chassis means 19 to the constructing means 1 and to dispose the constructing means 1 into working and transporting positions, and a pressure fluid pumping and controlling means 21 connected to the rams means 12 to 15, and a reel member 22 for the length of the pipe 17 and a cockpit means 23. The framework means 20 is supported on the chassis means 19 by hinge members 24 and 25 for movement about a horizontal preferably and transversal axis 26A and is able to be displaced into a lifted working position 20A to insert the constructing means 1 from a working position 1A into the ground and an excavated section and into a lower transporting position for displace the constructing means 1 into a transporting position 1B by an activating ram means 27. The framework means 21 comprises an engaging carrier member 28 connected to leg members of the framework means 21 for relative movement along the legs by an activating means such as a winch means (not shown) and provided with a yoke member 29 capable to be forced to move along and relative to the carrier member 28 by an activating means such as lead screw means (not shown) and adapted to engage and urge the carrier member 28 with the frame member 2 to move forward and about the axis 11A, the axis 26A and a longitudinal axis 30A by a pivot staple member 31. The constructing means 1 is capable to be disposed into the position 1A and folded about the axis 11A and an axis 32A of relative movement between the frame member 2 and the hopper member 16 and displaced into the position 1B for transportation, and turned about the axis 11A into working positions 1C and 1D for turning advancement of a cylindrical-shaped vertical trench section, and about the axis 30A into working positions 1E and 1F for advancement of inclined rectilinear and vertically conical-shaped excavation sections. The framework means 20 is provided with a guide member 33 for guiding the constructing means 1 being lifted and stop members and an activating means (not shown) for folding and fixing the constructing means 1 in the transporting position. The chassis means 19 comprises guiding wheels 34 connected with a coupling rod member 35 for transportation with a cargo tractor and supporting wheels 36 capable to be forced by the frame member 2 out of engagement with and support on the ground surface for resting the carrier member 28, the framework means 20, and the chassis means 19 on the frame member 2 being disposed in the working position.

Figure 4:
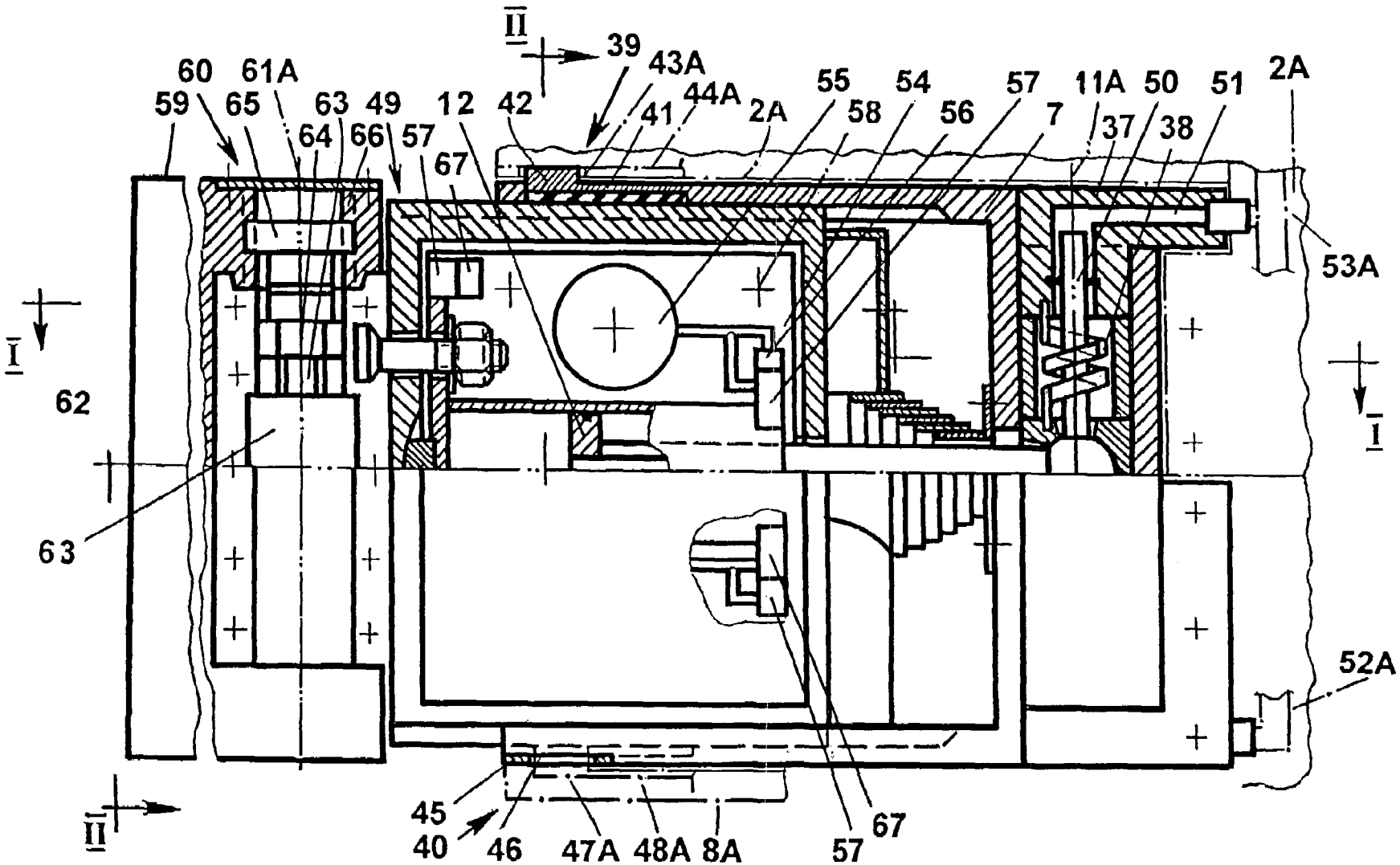
FIG. 4 is a side view and partly axial longitudinal vertical cross-sectional view of the excavation-directing and side walls-forming unit means 3 in FIG. 1 to FIG. 3.
Figure 5:
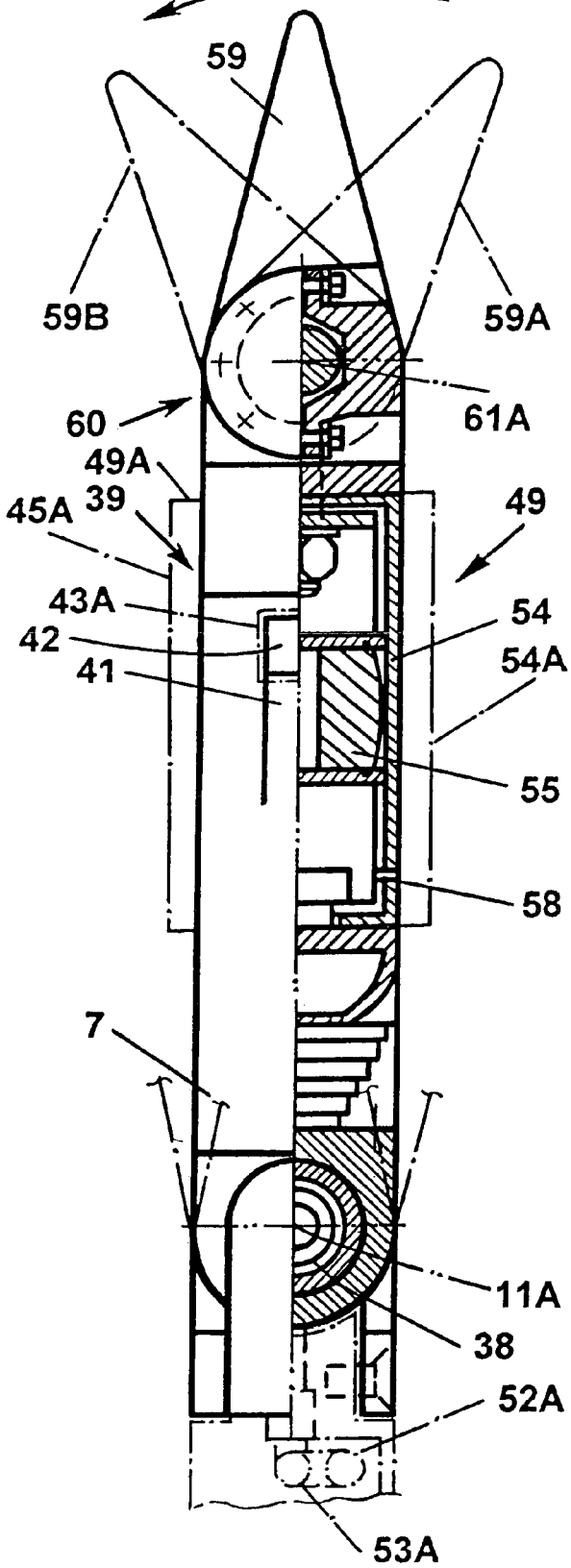
FIG. 5 is a plan view and partly cross-sectional view A-A of the unit means 3 in FIG. 4.
Figure 6:
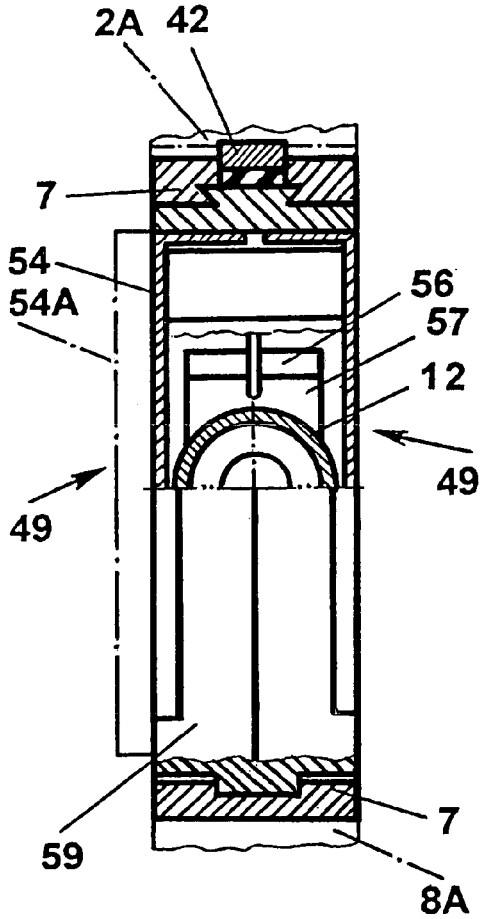
FIG. 6 is a front view and partly cross-sectional view B-B of the unit means 3 in FIG. 4 and FIG. 5.

FIG. 4 to FIG. 6 show the unit means 3 that is similar to the units means 4, 5, and 6 in FIG. 1 to FIG. 3 and with the ability to advance the slit trench section toward and in the diverged advancing direction. Its follower holding member 7 is connected to the frame member 2 by opposite hinge members 37 for movement about the axis 11A and comprises a well-known suitable angle gauge member 38 for remote measuring an angle of deflection of the unit means 3 from its central position and suitable engaging catch lock members 39 and 40 adapted to impede the unit means 3 against deflection from the central position relative to an adjacent from above portion 2A of the frame member 2 and adjacent from below the follower holding member 8 (in a position 8A) of the unit means 4 and to release the unit means 3 for deflection aside leftward and rightward because its impact with the buried boulder larger than a predetermined size that is equal to about 25 centimetres of the diameter, for instance. The lock member 39 is provided with a spring member 41 and a cam member 42 mounted on the follower member 7 and capable to be forced into engagement with a socket member 43 (in a position 43A) of a spring member 44 (in a position 44A) mounted on the portion 2A, and the same lock member 40 is provided with a spring member 45 and a socket member 46 that is capable to be forced into engagement with a cam member 47 (in a position 47A) of a spring member 48 (in a position 48A) mounted on the follower holding member 8 (in a position 8A). Because of several variables, forms and dimensions of the lock members 39 and 40 should be determined by testing to provide a disengaging force equal to about 1 to 2 tons, for instance. The unit means 3 comprises a side walls-forming and supporting member 49 adapted to force, form and support the walls and connected to the holding member 7 by opposite slides for movement in radial directions with the ram means 11. Ends of the ram means 11 are capable to be connected separately to the supplying and controlling means 21 through a co-axial piston rod member and pipe members 50 and channels 51 and conduit members 52 (in a position 52A) and 53 (in a position 53A). The forming member 49 is with the ability to be forced to turn about the axis 11A toward the intended advancing direction and form the conical- and cylindrical-shaped walls and be changed in its volume and expanded and outwardly forced into compressive engagement with the side walls being supported by the member 49 to form the walls and immobilised relative to the walls and shrinked and inwardly forced out of the compressive engagement to easy the its advancement and has side wall-forming and supporting portions 54 being movable reciprocatingly in transversal directions and capable to force, form and engage with the walls and operable to expand the supporting member 49 for forming and compressive engaging with the walls and to shrink the member 49 for releasing from the compressive engaging with the walls by an activating means such as two interacting hydraulic power activating means 55 connected hydraulically to the rod end of the ram means 11 through an usual suitable relief valve means 56 which is able to be open with fluid pressure more than the predetermined quantity of fluid pressure required for effecting movement together of the frame member 2 and the supporting member 49 and by an usual suitable check valve means 57, which is able to be open for reverse flow of the pressure fluid from the activating means 55 toward the ram means 11 and closed for flow of the fluid toward the activating means 55, and by return spring members 58.

The unit means 3 comprises an excavation-directing and making cutter member 59 adapted to force continuously the facial wall at the cutter member 59 in a direction crossing the facial wall and opposite of the diverged direction to cause the cutter member 59 to excavate a section of the excavation, be forced continuously toward and in the diverged direction, force continuously the support member 49 and the frame member 2 toward the diverged direction to force and form the side walls toward the diverged direction so to advance the excavation in the diverged direction and control the direction of the excavation, and provided with excavation-making portions capable to force continuously the facial wall in the direction opposite of the diverged direction and crossing the tangent of the central longitudinal axis of the section being formed and be forced continuously by the wall toward the diverged direction and force continuously the support member 49 that being movable part of the frame member 2 and operable by an activating means of the apparatus capable to move the portions relative to and with the support member 49 for controlling the direction and the force of forcing the facial wall and the side walls toward the intended diverged direction and advancing turningly aside the unit means 3 for forming the conical- and cylindrical-shaped side walls and advancing a section of the excavation toward and in the intended diverged direction. The cutter member 59 must correspond to characteristics of the ground, so for the ground that includes large and mainly ball-shaped boulders that is, for instance, the wedge-shaped cutter member connected to the following support member 49 of the frame member 2 by hinge members 60 for movement about an axis 61A on the central longitudinal surface of the cutter member 59 and the support member 49 and preferably perpendicular to the directions of radial movement of the unit means 3. The cutter member 59 is able to be forced to move about the axis 61A through an arc of about 60° by an activating and drive means 62 located between the cutter member 59 and the support member 49 within the section being excavated and comprising an activating motive power means such as a hydraulic power two rods and piston unit means 63 having longitudinally displaceable opposite output piston rod members disposed co-axially with the axis 61A and a drive turning screw-and-nut mechanism including a cross-head 64 with longitudinally splined bearing portions leaning on correspondingly splined bearing portions of the support member 49 for axial longitudinal displacement and engaging screw-shaped portions 65 being capable of interacting with corresponding engaged screw nut-shaped portions 66 of the member 49. The rod members of the activating means 63 are able to be forced by fluid pressure for movement along the axis 61A and forcing relatively the screw portion 65 to the screw nut portion 66 to move the nut portion 66 together with the cutter member 59 about the axis 61A relatively to the support member 49. The moved aside, stopped and being advanced cutter member 59 is capable to force the support member 49 remotely from the axis 1A so to rove the unit means 3 about the axis 11A correspondingly aside relative to the frame member 2. Ends of the activating means 63 are able to be connected hydraulically and independently with different ends of the ram means 12 through usual suitable relief valve means 67 capable to be open with fluid pressure more than the predetermined quantity of the fluid pressure required for effecting relative movement between the frame member 2 and member 49 for reverse flow of the fluid from the activating means 63 toward the ram means 12 and closed for flow from the ram means 12 toward the activating means 63. A rate of an angle of deflection of the cutter member 59 aside leftward and rightward, the rate is depended on a length of a stroke and a form of the screw member 65 and the nut member 66 and equal up to about 30° leftward and rightward and capable to be controlled with a volume of the fluid being fed by the supplying and controlling means 21 into the activating means 63, for instance. The rate of the angle of deflection of each of the cutter members 59 is determined accordingly to the intended positions 1C, 1D, 1E and 1F of the constructing means 1 about and distances of the units means 3 to 6 from the axes 11A, 26A and 30A (shown in FIG. 1 to FIG. 3). The activating and drive means 62 is capable to fix the cutter member 59 to be stationary relative to the frame member 2

A method for continuous advancement of a curvilinear and narrow section of an excavation used in the construction of an underground structure, the method is shown for operation of the above-described apparatus for constructing an underground curvilinear and narrow horizontally extending drain pipeline, the method comprising the following steps: (a) operating the activating means of the apparatus to advance the movable chassis means 19 along an excavation line and insert the excavation-directing and making units means 3 to 6 at a working position into the ground to a predetermined depth in the excavation and a distance in an intended advancing direction so that the units means 3 to 6 form the section of the excavation along the excavation line, the direction of the excavation diverges from the central longitudinal axis and is determined; (b) operating the activating and drive means 62 of each of the units means 3 to 6 to move the directing and making cutter members 59 about the axis 61A relative to the support members 49 into an intended working position for forcing the support members 49 of the follower frame member 2 toward and advancement of the excavation toward and in the diverged direction; (c) operating the activating means of the apparatus to move the support members 49 with the follower frame member 2 in the direction of the tangent of the intended advancing direction at the support members 49 to cause the cutter members 59 of the units means 3 to 6 to excavate the section and force continuously the ground of the facial wall of the section being excavated at the cutter members 59 in a direction crossing the tangent and opposite of the diverged direction to cause the cutter members 59 to be forced and force continuously the support members 49 of the units 3 to 6 to move about the axis 11A relative to the follower frame member 2 toward the diverged direction so to force continuously and form the side walls at the support members 49 toward the diverged direction and advance the trench toward and in the diverged direction.

The activating and drive means 62 and the ram means 12 to 15 of the units means 3 to 6 are located within the section that is formed by forces applied to the walls of the section and the frame member 2 by the directing and making cutter members 59 of the units means 3 to 6.

The method further comprises the following steps: (d) operating the ram means 12 to 15 to advance the cutter member 59 with the support members 49 relative to the frame member 2 with pulling force which must be no more than about 45 tons (and from 20 to 50 tons for the ram means 13 to 15 of the unit means 4 to 6) and to stop within the formed section to support the walls; (e) operating the activating means 55 of the units 3 to 6 to move wall-supporting portions 54 of the stopped support members 49 outwardly in opposite directions against and into compressive engagement with the walls of the section to overcome the ground resistance to compression, where the resistance may be equal to about 50 tons (from 25 to 60 tons for the unit means 4 to 6) and form the walls and immobilise the support members 49 relative to the walls; (f) operating the activating means 55 of the units means 3 to 6 to effect longitudinal uninterruptible turning movement about the axis 11A in the opposite directions between the frame member 2 and each of the support members 49 to advance turningly about the axis 11A the frame member 2 and the rest hopper member 16 and the chassis means 19 relative to the stopped and immobilised support members 49 and turning relatively the frame member 2 and the hopper member 16 about the axis 32A and the hopper member 16 relative to the excavated section toward and in the diverged advancing direction at a speed, V1, where the speed must be equal to a speed of movement of the constructing means 1 in the same direction with the chassis means 19 to cause the constructing means 1 to decrease the traction by and the overturning moment about the chassis means 20.

The speed V1 of the continuous uniform movement of the frame member 2 relative to the support members 49 is secured by operating the activating means 55 to effect the alternate longitudinal uninterruptible turning movement about the axes 11A in the opposite directions between the frame member 2 and each of the support members 49, n, with the same preferably distances and speeds, V2, relative to the frame member 2, and V3, relative to the ground, where the speeds must be equal to no less than about $V2=(0.5n-1)\times V1$, and $V3=0.5n\times V1$.

Figure 7A:
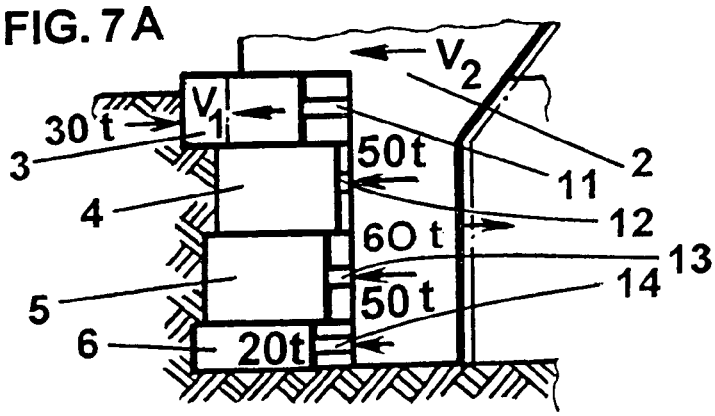
FIG. 7A to FIG. 7D are a diagram means of steps of continuous advancement of the constructing means 1 in FIG. 1 to FIG. 3 according to the method of the invention.
Figure 7B:
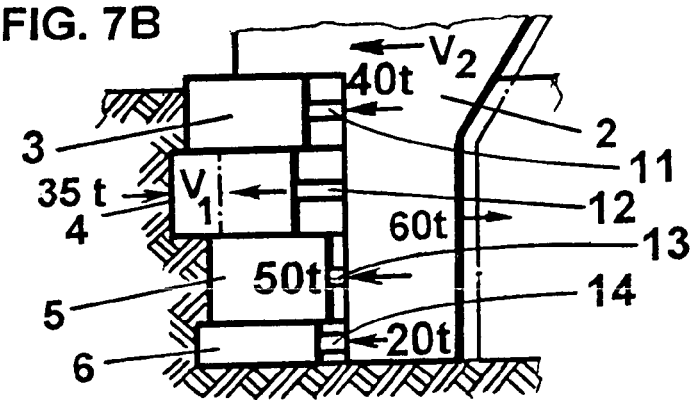
Figure 7C:
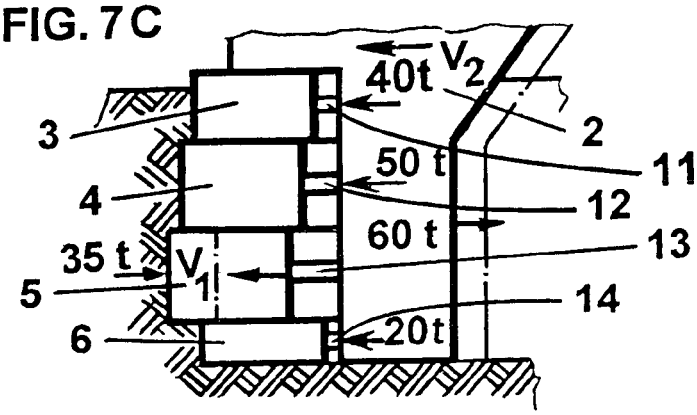
Figure 7D:
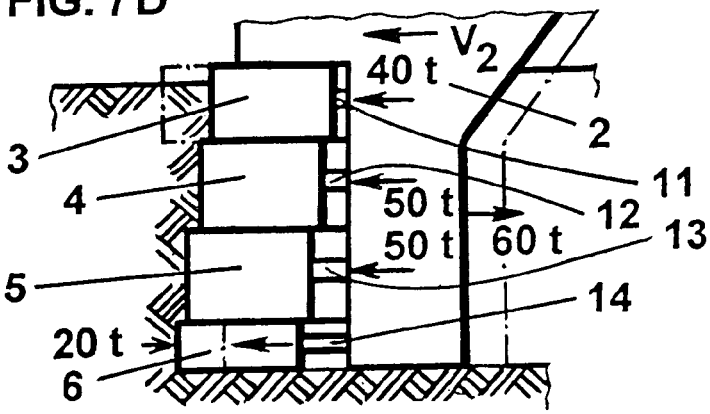

Referring to FIG. 7 it may be seen that for continuous movement forward of the constructing means 1 the ram means 12, for instance, moves the unit means 3 forward as it is shown in FIG. 7A relatively to the frame member 2 with the force equal to about 30 t, while the unit means 4, 5 and 6 continue to be temporarily stationary and supporting the walls and their ram means 13, 14 and 15 continue to move the frame member 2 and the rest forward from and relatively to the unit means 4, 5 and 6 with the common traction that is equal up to about 50 t+50 t+20 t=120 tons, for instance, and sufficient for advancement of the apparatus. As soon as the ram means 12 ends its pushing working stroke and stops the unit means 3 ahead of the frame member 2 the ram means 12 starts its pulling stroke with the force 40 t to advance the frame member 2 and the rest relatively to the unit means 3, and simultaneously the ram means 13 of the unit means 4, for instance, ends its pulling stroke with the force 50 t (it is shown in FIG. 7A) to move the frame member 2 relatively to the unit means 4 and starts at once its pushing stroke with the force 35 t to advance the unit means 4 relative to the frame member 2 (see FIG. 7B), while the unit means 3, 5 and 6 are stationary and their rams means 12, 14 and 15 advance the frame member 2 toward the units means 3, 5 and 6 with a common traction that is equal up to about 40 t+50 t+20 t=110 tons and sufficient for the advancement of the apparatus. Then these actions are repeated by the unit means 5 (it is shown in FIG. 7C) and the unit means 6 (it is shown in FIG. 7D). On that a cycle of actions of the units means 3 to 6 is ended and the same cycles are repeated until the entire predetermined length of the excavation is passed by the constructing means 1 being continuously advanced and simultaneously feeding into and laying the length of the drain pipe and filter sand in the excavated section.

Figures 8A, 8B, 8C, 8D, 8E, 8F, 8G, 8H:
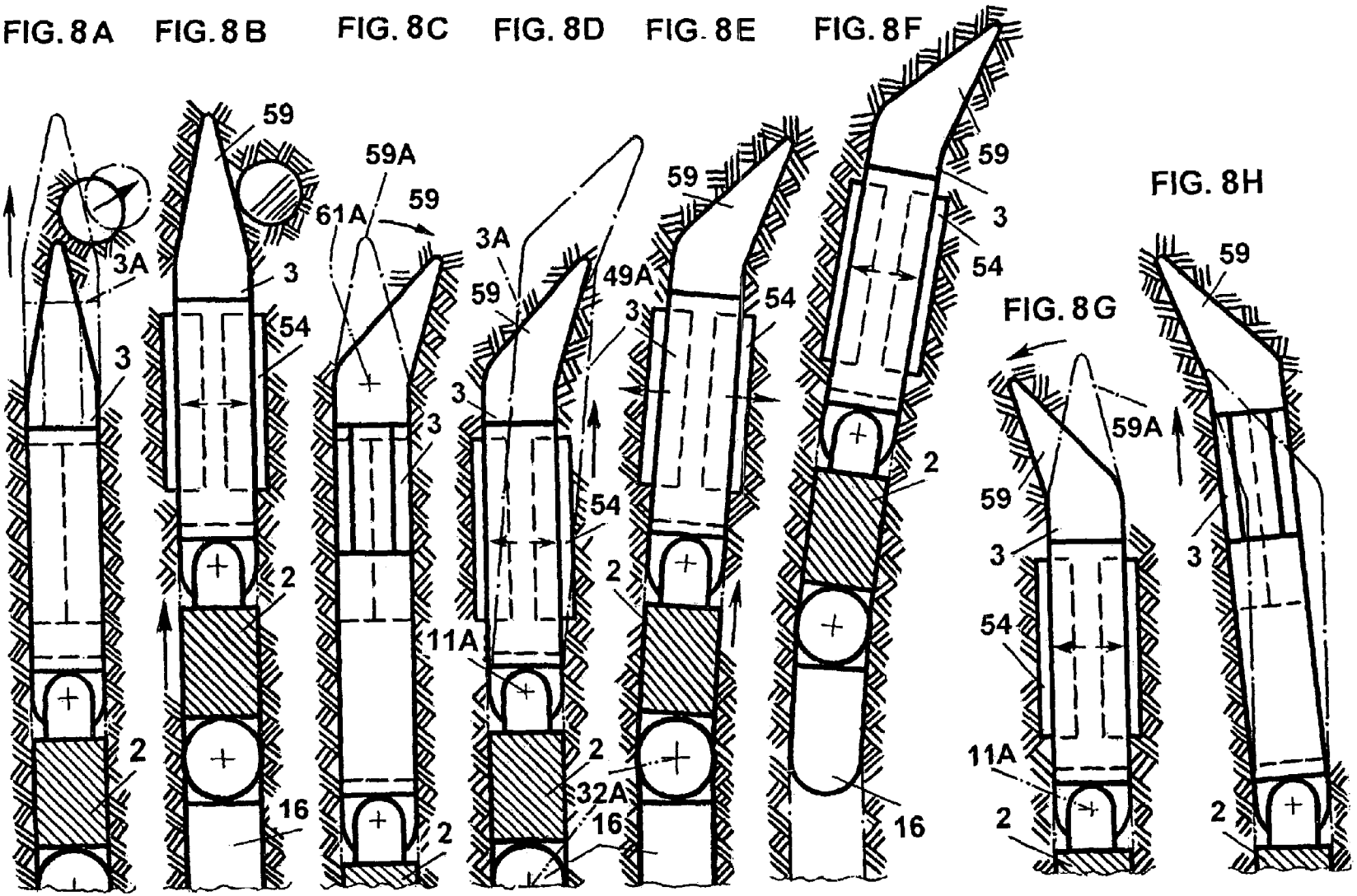
FIG. 8A and FIG. 8B are a diagram means of steps of advancement of the frame 2 and the unit means 3 in FIG. 1 to FIG. 3 according to the method of the invention.
FIG. 8C to FIG. 8F are a diagram means of steps of rightward turning advancement of the frame member 2 and the unit means 3.
FIG. 8G and FIG. 8H are a diagram means of steps of leftward turning advancement of the frame member 2 and the unit means 3 in FIG. 1 to FIG. 3.

Referring to FIG. 8 it may be seen that the ram means 12, for instance (see FIG. 8A) performs its pushing stroke and advances the unit means 3 relatively to the frame member 2 and in case of an impact with a ball-shaped buried boulder weighing under about 25 kilogram, for instance, the unit means 3 is retained by the lock means 39 and 40 (shown in FIG. 4 and FIG. 5) in its central position and moves the boulder aside. When the ram means 12 stops the unit means 3 (see FIG. 8B), the unit means 3 forces into interaction with to form the walls and moves each of the supporting portions 54 aside in opposite directions by the activating means 55 and simultaneously the ram means 12 starts relative movement together of the unit means 3 and the frame member 2, and the rest with forcing and forming the side walls by performing its pulling stroke. Just as the ram means 12 ends its pulling stroke, a cycle of actions of the unit means 3 is ended.

For turning aside the cutter member 59 of the unit means 3, for instance from the central position 59A rightward (see FIG. 8C) the supplying and controlling means 21 (see FIG. 1) feeds the pressure fluid into the head end of the ram means 12 under pressure which should be more than the pressure required for effecting the pushing stroke and sufficient for opening the valve means 67 and feeding the fluid into the upper piston rod end of the activating means 63 and connect the piston rod end of the ram means 12 to the hydraulic tank. After the cutter member 59 is turned, the activating means 55 force the portions 54 of the unit means 3 outwardly and simultaneously the ram means 12 advances the frame member 2 and the rest so to force and form the walls as it shown above and in FIG. 8D. Then the ram means 12 advances the unit means 3. A left facial wall-forcing portion of the cutter member 59 that is remote from the axis 11A and deflected rightward and moved forward and compressing the ground to the leftward. This compressed ground is capable of creating a high torque about the axis 11A and turning the unit means 3 to the rightward as well about the axis 11A with forcing and forming the right wall. The unit means 3 repeats the suitable actions for further diverging advancement of the excavation (see FIG. 8E and FIG. 8F) at a radius of curvature equal to about six meters, for instance. For moving the cutter member 59 about the axis 61A aside to the leftward as it is shown in FIG. 8G, the supplying and controlling means 21 feeds the pressure fluid into the ram means 12 piston rod end under pressure which should be more than the pressure required for effecting its pulling stroke and sufficient for opening the valve means 67 to feed the fluid into the activating means 63 lower piston rod end and connect the ram means 12 head end to the tank. Then the unit means 3 starts its diverging movement forward to a position in FIG. 8H and further as above.

Figures 9A, 9B, 9C, 9D, 9E, 9F:
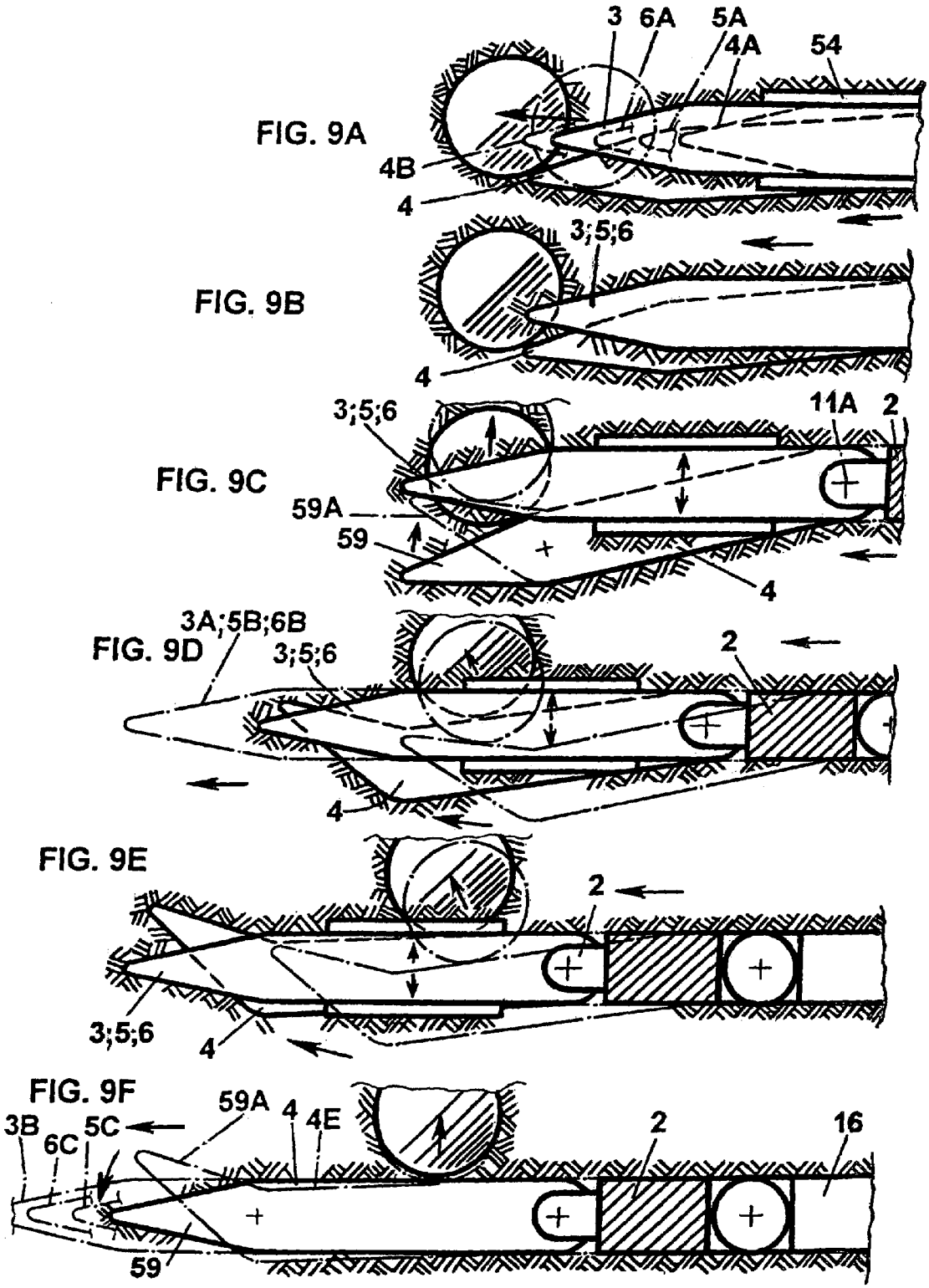
FIG. 9A to FIG. 9F are a diagram means of steps of rectilinear advancement of the constructing means 1 in FIG. 1 to FIG. 3 after its impact with a large surmountable buried ball-shaped boulder, according to the method of the present invention.

In case of a sliding impact of any one of the units means 3 to 6 being advanced, for instance, the unit means 4 with a buried boulder larger than the first predetermined mass, such as about 25 kilogram, but smaller than a second predetermined size of 60 centimetres, for instance (it is shown in FIG. 9A), the unit means 4 can push the boulder aside relatively to the frame member 2 and at the same time is forced by the boulder to move aside in an opposite direction relatively to other units means 3, 5 and 6, and the frame member 2 and breaks up the locks means, 39 and 40 of its follower member 8 (shown in FIG. 1, and FIG. 4 to FIG. 6) and is deflected to the leftward, for instance, from a central position 4A and an intended position 4B and displaced relatively to the frame member 2 and moving its follower member 8 about the axis 11A and deforming the deflection angle gauge means 38 (shown in FIG. 4), which is capable of signalling to the controlling means 21 about a direction and an angle of the deflection of the unit means 4 to stop at once all the activating means of the apparatus. Then a position, sizes and shape of the boulder are explored remotely by a well-known suitable measuring means, such as an sonar means to determine when to operate the multiple activating means to effect further advancement of the section being excavated. If there is the boulder of a size smaller than about the second predetermined size, equal to about 50 centimetres in diameter, for Instance, the unit means 4 can move the boulder further aside relatively to the frame member 2 by operating the activating means 55 of the unit means 3, 5 and 6 to effect movement of the portions 54 into the members 49 and then operating the rams means 12, 14 and 15 to effect advancement of the units means 3, 5 and 6 relative to the frame member 2 and stopping them at the same positions 3(5, 6)A in FIG. 9B, then operating the activating means 55 of the units means 3, 5 and 6 to effect movement of the portions 54 outside and operating the rams means 12, 14 and 15 to effect advancement of the frame member 2 together with the rest up to the units means 3, 5 and 6 and stopping, and repeating these two actions until the units means 3, 5 and 6 are at positions 3(5, 6)B and the frame member 2 is at position 2A and the unit means 4 is at a position 4C in FIG. 9C, and when the cutter member 59 is on one side at the boulder then operating the activating means 63 of the unit means 4 to effect movement of the cutter member 59 about the axis 61A toward and behind the boulder up to a deviated to the rightward position 59B, and operating the activating means 55 of the units means 3, 5 and 6 to effect movement of the units means 3, 5 and 6 and stop at the same positions 3(5, 6)C in FIG. 9D and again operating the activating means 55 to effect movement of the portions 54 outside and operating the rams means 12, 14 and 15 to effect advancement of the frame member 2 together with unit means 4 and the rest up to positions 2B and 4D in FIG. 9D with pushing the boulder further aside, and repeating the actions until the angle gauge means 38 of the deflected unit means 4 signals to the controlling and supplying means 21 that the deflection angle is come to about nought, and then the controlling and supplying means 21 stops immediately the frame member 2 at a position 2C and the units means 3, 5 and 6 at positions 3(5, 6)D and 4F in FIG. 9E and then operates the activating means 63 of the unit means 4 to effect turning movement of the cutter member 59 from right position 59A up to its central position in FIG. 9F to follow positions of the rest unit means 3E, 5E and 6E and after that operates all the rams means 12 to 15 to effect further continuous movement of the constructing means 1 and apparatus past the boulder.

Figures 10A, 10B, 10C, 10D:
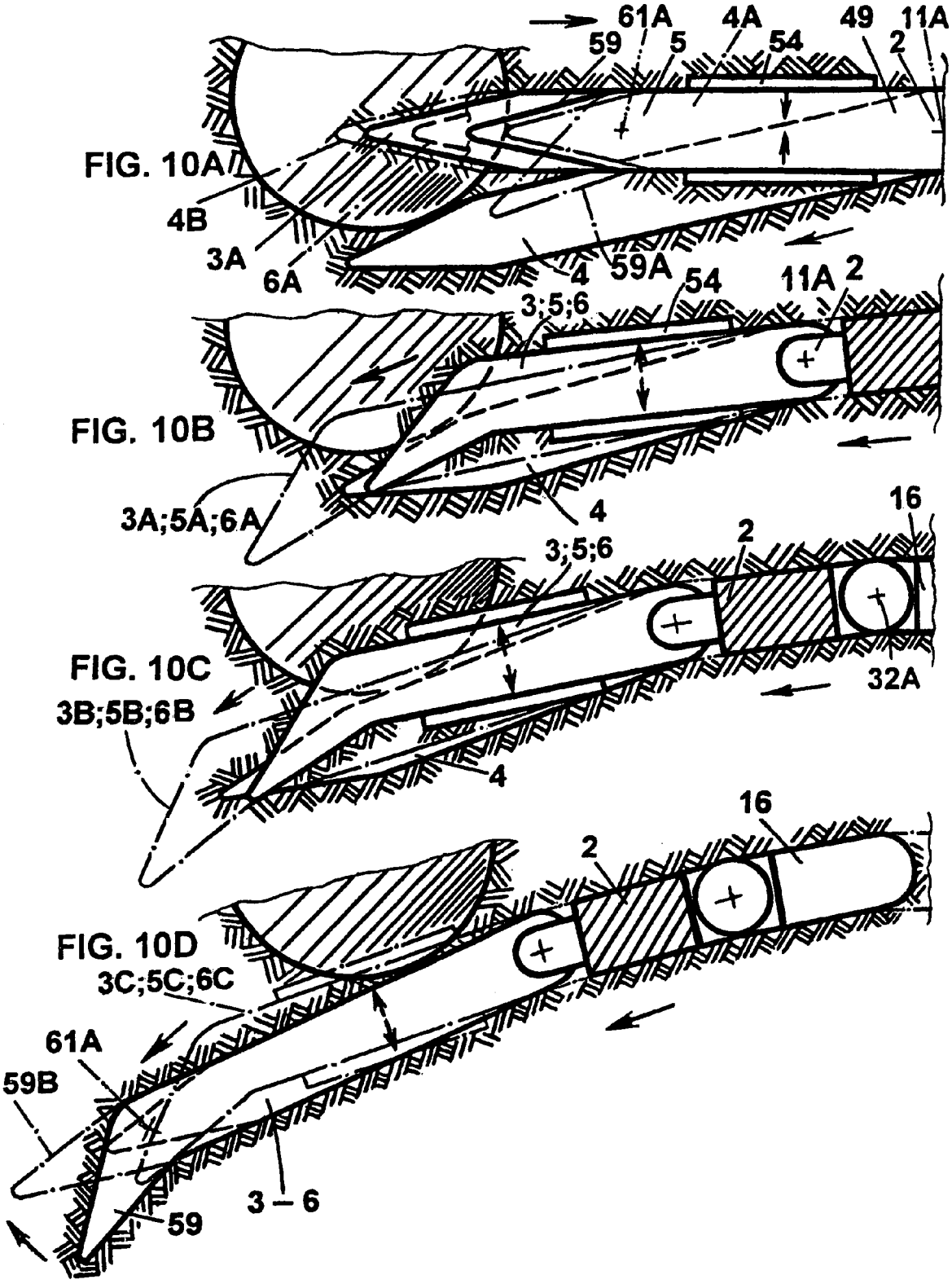
FIG. 10A to FIG. 10D are a diagram means of steps of leftward turning advancement of the constructing means 1 in FIG. 1 to FIG. 3 after its sliding impact with an insurmountable buried ball-shaped boulder, according to the method of the invention.

If the exploration discovers that the buried boulder has the third predetermined size, which is equal to about 100 centimetres in diameter, for instance, then it is possible to advance divergingly the constructing means 1 around the boulder by (see FIG. 10A) operating the activating means 55 of each of the units means 3, 5 and 6 to effect movement of the portions 54 into the members 49 and then operating the rams means 12 and 15 to effect movement of the units means 3 and 6 from their advanced positions 3A and 6A backward up and relative to the stopped frame member 2 up to the same positions 3(5, 6)B and operating the activating means 63 of each of the units means 3, 5 and 6 to effect movement of its cutter member 59 about the axis 61A toward the unit means 4 deflected by the boulder from a position 4A into a position 4B toward a position 4C to an angle equal up to about 300 into a position 59A, and operating alternately the rams means 12, 14, and 15 to effect advancement of the units means 3, 5 and 6 with displacing aside toward the unit means 4 and stop at the same positions 3(5, 6)C in FIG. 10B, then operating the activating means 55 of each of the units means 3 to 6 to effect movement of its portions 54 outside and operating the rams means 12 to 15 to effect advancement of the frame member 2 and the rest relative and up to the units means 3 to 6 from positions 2A and 4C into positions 2B and 4D, and repeating same suitable operations with advancing alternately the units means 3, 5 and 6 and the frame member 2 together with the unit means 4 and the rest through positions 3(5, 6)D, 3(5, 6)E, 2C and 4E in FIGS. 10C and 3(5, 6)E, 3(5, 6)F, 2D and 4F in FIG. 10D until the angles of deflections of the follower members 8 that being measured by the gauge means 38 shown in FIG. 6 of all the units means 3 to 6 become the same and the locks means 39 and 40 shown in FIG. 4 and FIG. 5 engage together the follower members 7 to 9 of the units means 3 to 5 and then operating the activating and guide means 62 of each of the units means 3, 5, and 6 to effect diverging movement of its cutter member 59 about the axis 61A into its central position 59B in FIG. 10D and operating all the rams means 12 to 15 to effect advancement of the constructing means 1 and the apparatus toward the predetermined excavation line with repeating the same suitable operations.

Figures 11A, 11B, 11C, 11D:
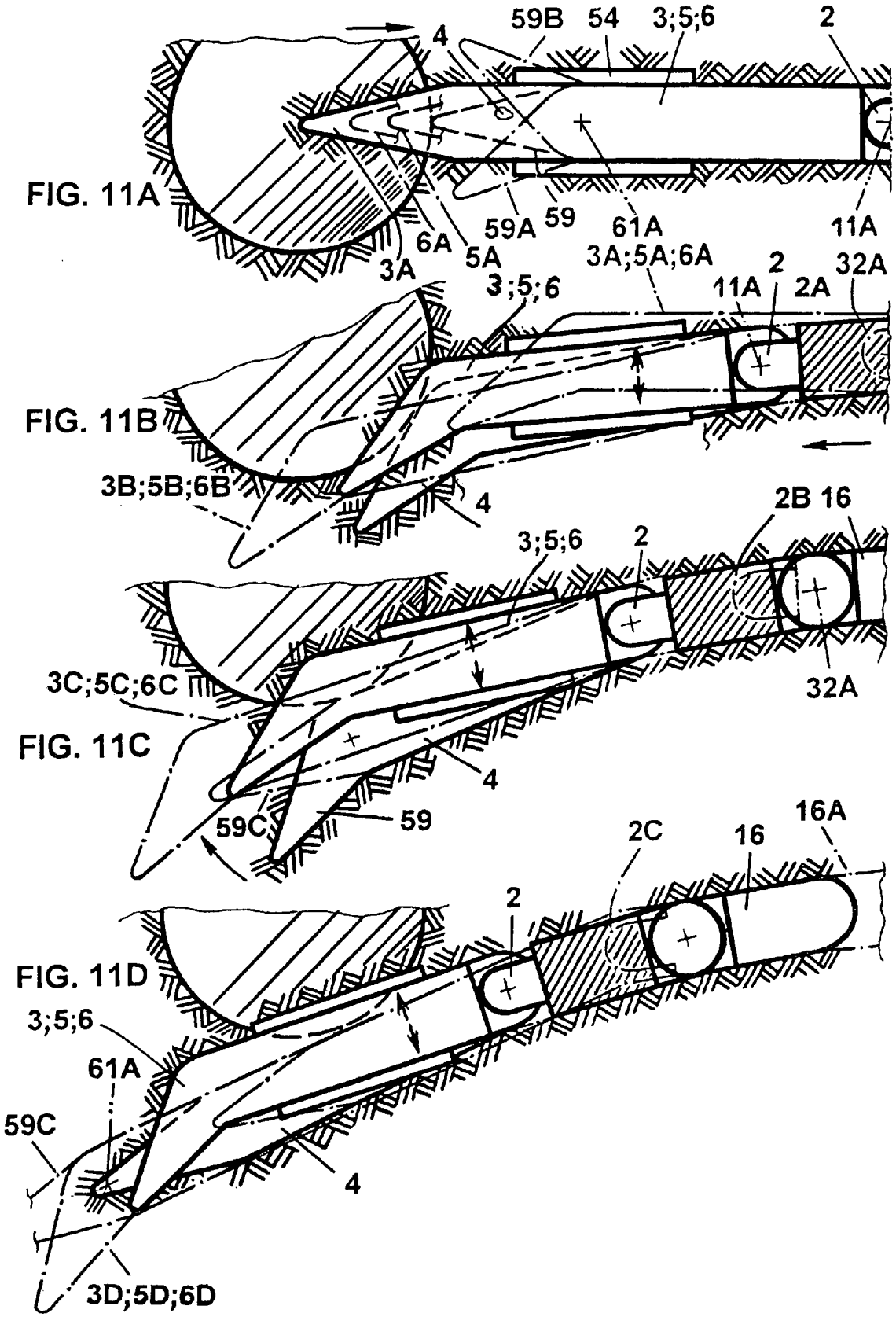
FIG. 11A to FIG. 11D are a diagram means of steps of leftward turning advancement of the constructing means 1 in FIG. 1 to FIG. 3 after its stoppage by an insurmountable buried ball-shaped boulder, according to the method of the present invention.

In case of a central impact of any one of the units means 3 to 6, for instance, the unit means 4 with a buried boulder of about 50 to 100 centimeters in the diameter (it is shown in FIG. 11A), the unit means 4 is stopped by the boulder and a suitable usual transducer means like, for instance, a pressure fluid delivery volume transducer of the controlling and supplying means 21 signals right away to close urgently feeding the rams means 12 to 15 and stop the advancement of the constructing means 1 and the apparatus and after remote exploration of the boulder and determination of a suitable direction of further diverging movement of the units means 3 to 6 the constructing means 1 is advancing around the boulder by operating the activating and drive means 62 of the unit means 4 to effect movement of its cutter member 59 about the axis 61A toward either a left position 59A or a rightward position 59B accordingly to results of the exploration, into the left position 59A, for example, at an angle equal up to about 30° and operating the ram means 13 to effect advancement and leftward deflection of the unit means 4 relative to the frame member 2 by the boulder accordingly to the deflected position of its cutter member 59 (it is shown in FIG. 11B) with breaking the locks means 39 and 40 and moving about the axis 11A at an angle being measured by the gauge means 38 of its follower member 8 and stop, and operating the activating means 55 of each of the units means 3, 5 and 6 to effect movement of the portions 54 into the members 49 and alternately operating the rams means 12, 14 and 15 for effecting movement of the units means 3, 5 and 6 backward relative and up to the stopped frame member 2 from positions 3A, 5A and 6A and stop at the same positions 3A(5A, 6A) in FIG. 11B and operating the activating and drive means 62 of each of the units means 3, 5, and 6 for effecting turning movement of its cutter member 59 about the axis 61A leftward toward the direction of the deflection of the unit means 4 at the same angles which should be equal up to about 30° and then alternately operating the rams means 12, 14 and 15 of the units means 3, 5 and 6 for effecting advancement of them relative to the stopped frame member 2 from the positions 3A(5A, 6A) and stop at the same positions 3(5, 6)A and operating the activating means 55 of each of the stopped units means 3, 5 and 6 to effect movement of its portions 54 outside and again operating the rams means 12, 14 and 15 to effect advancement of the frame member 2 together with the rest from its position 2A and stopping at a position 2B in FIG. 11B and r peat the operations for alternate advancement of the units means 3, 5 and 6 into positions 3(5, 6)B and the frame member 2 pushing forward the unit means 4 and pulling forward the rest until the unit means 4 is aside the boulder and stopped, then operating the activating and drive means 62 of the unit means 4 to effect return movement of its cutter member 59 about the axis 61A rightward up to its central position 59C in FIG. 11C and further repeating the steps to the positions shown as 3(5, 6)C and 3(5, 6)D in FIG. 11D until the angle gauge means 38 of the units means 3, 5 and 6 at the same positions 3(5, 6)D have signalled to the controlling and supplying means 21 that their deflection angles have become no less than such angle for the unit means 4, then operating the activating and drive means 62 of each of the units means 3, 5 and 6 to effect return movement of its cutter member 59 about the axis 61A into its central position 59C and further repeating the suitable operations of the multiple activating means for continuous converging advancement of the excavation toward and then along the line.

Figures 12A, 12B, 12C, 12D, 13A, 13B, 13C:
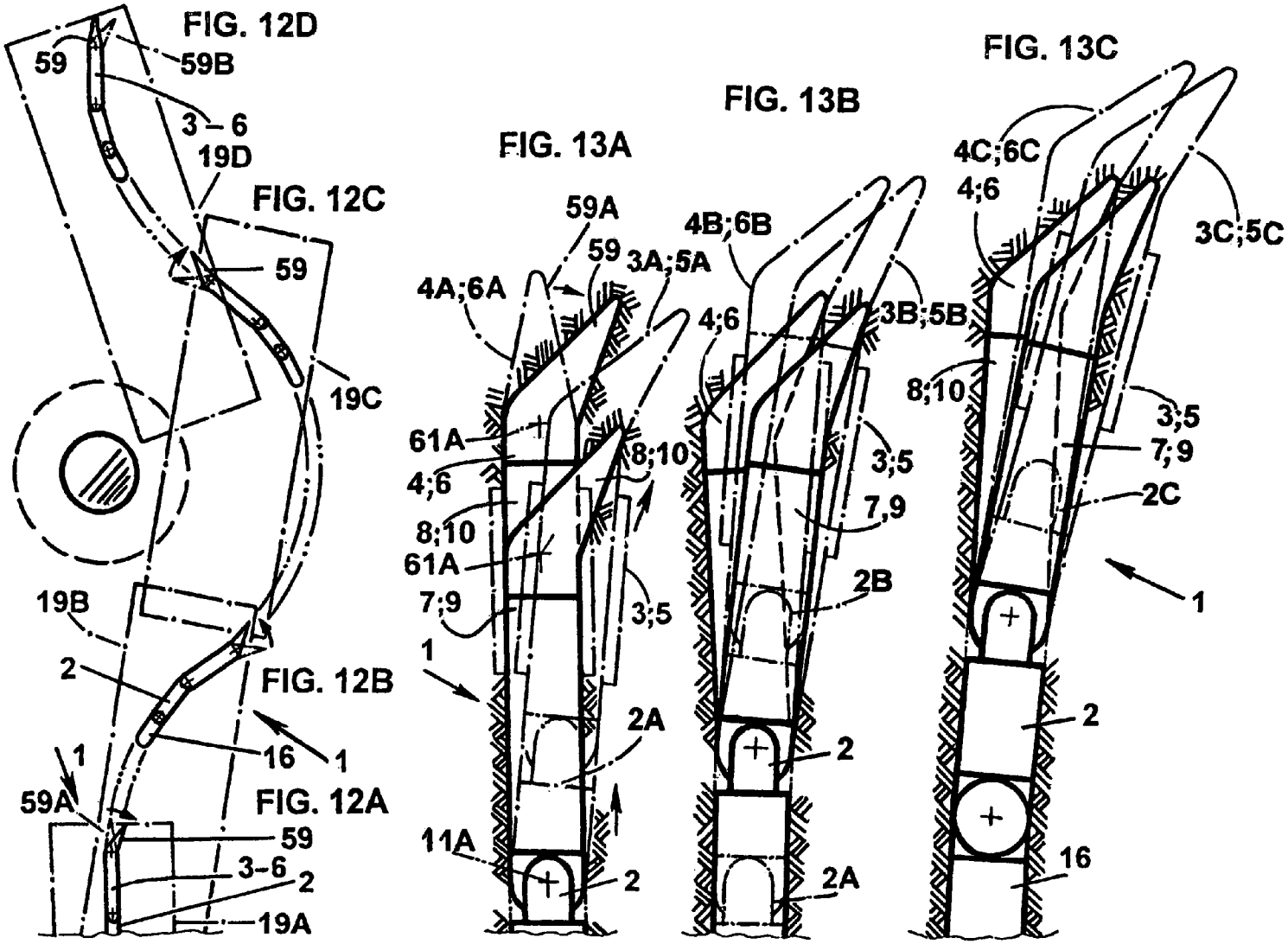
FIG. 12A to FIG. 12D are a diagram means of steps of turning advancement of the apparatus with the constructing means 1 in FIG. 1 to FIG. 3 round a very large buried boulder, according to the method of present invention.
FIG. 13A to FIG. 13C are a diagram of steps of rightward turning advancement of the units means 3 to 6, the frame member 2, and the hopper member 16 in FIG. 12.

If the running apparatus came across an insurmountable buried boulder and a rock (see FIG. 12), then the apparatus stops at about five to seven meters distance, for instance, before the boulder (it is shown in FIG. 12A) and starts to advance the excavation round the boulder by operating the activating means 55 of each of the units means 3 to 6 to effect movement of its portions 54 into the members 49 and the rams means 12 to 15 to effect alternate backward movement of each of the stopped units means 3 to 6 relative and up to the stopped frame member 2, and operating the activating and drive means 62 of each of the units means 3 to 6 to effect movement of its cutter member 59 about the axis 61A from the central position 59A in a desired rightward direction, for instance, at an angle equal up to about 30° and operating alternately the rams means 12 to 15 to effect turning advancement and stopping of the units means 3 to 6 with breaking and engaging again the locks means 39 and 40 and the activating means 55 to effect movement of the portions 54 inside and outside the support members 49 and operating the rams means 12 to 15 to effect advancement of the frame member 2 together with the hopper member 16 and repeating the operations about ten times, for instance, to reach an end of the way of the rightward turning advancement of the excavation section at the position in FIG. 12B and to advance turningly the chassis means from a position 19A into a position 19B, then operating the activating and drive means 62 of the units means 3 to 6 to effect leftward movement of the cutter members 59 about the axis 61A at an angle equal up to about 60° and then repeating same operations about fifteen times, for instance, to effect leftward turning advancement of the excavation section to reach an end of the way of the advancement at the position in FIG. 12C and to advance the chassis means into a position 19C, then operating the activating and drive means 62 of each of the units means 3 to 6 to effect rightward movement of its cutter member 59 about the axis 61A at an angle equal up to about 60° and repeating the same operations about ten times; for instance, for rightward turning advancement of the excavation section to reach an end of the way of the advancement at the position in FIG. 12D and to advance the chassis means into a position 19D, then operating the activating and drive means 62 to effect movement of the cutter members 59 about the axis 61A from the position 59B leftward into the central position. With that the cycle of operations of the constructing means 1 for continuous advancement of the excavation and the chassis means 19 round the very large boulder is ended and the excavation is further advanced along the line.

In FIG. 13 there are shown the following steps of diverging advancement of the excavation without the frequent breaking and re-engaging the locks means 39 and 40 of the follower members 7 to 10 shown in FIG. 1, FIG. 4 and FIG. 6. The steps include operating the activating means 55 of the even, for instance, units means 4 and 6 stopped closely to the frame member 2 to effect movement of the support portions 54 into their support members 49 and the rams means 13 and 15 to effect advancement into and stopping at about the same positions 4(6)A and operating the activating and drive means 62 of the units means 4 and 6 to effect movement of the cutter members 59 about the axis 61A from the central position 59A rightward, for instance, at the angle about 30°, then operating the activating and drive means 62 of the odd units means 3 and 5 stopped closely to the frame member 2 to effect the movement of their cutter members 59 about the axis 61A at the angle 30° and operating the activating means 55 of the odd units means 3 and 5 to effect movement of the support portions 54 into the support members 49 and operating the rams means 12 and 14 to effect alternate rightward turning advancement and stopping of the odd units means 3 and 5 at about the same positions 3(5)A in FIG. 13A and creating a small acute angle about the axis 11A between the even units means 4 and 6 on the one hand and the odd units means 3 and 5 on the other hand; then operating the activating means 55 of the even units means 4 and 6 to effect movement of their support portions 54 into their support members 49 and the rams means 13 and 15 to effect advancement and stopping the even units means 4 and 6 at about the same positions 4(6)A and the activating and drive means 62 of the units means 4 and 6 to effect movement of the cutter members 59 about the axis 61A from the central position 59A rightward at the angle about 30°, then operating the rams means 12 to 15 of the units means 3 to 6 to effect advancement of the frame member 2 relative and up to the units means 3 to 6 into a position 2A and after that repeating the suitable operations to advance alternately the units means 3 to 6 and the frame member 2 into positions 3(5)B, 4(6)B and 2C in FIG. 13B, and 3(5)C, 4(6)C and 2D in FIG. 13C. Those positions show that the even advancing units means 4 and 6 and their follower holding members 8 and 10 shown in FIG. 1 and FIG. 4 to FIG. 6 and the odd units means 3 and 5 and their follower holding members 7 and 9 continue to create the constant approximately and very small acute angle that angle is sufficient to prevent the frequent breaking and engaging the locks means 39 and 40 during the diverging advancement of the constructing means 1.

The constructing means 1 is with the ability to control the depth of the excavation section being formed with its movement about the axis 26A by means of different speeds of relative advancement of the frame member 2 to each of the units means 3 to 6 corresponding to distances of the units means 3 to 6 from the axis 26A; and to turn about the axis 30A with movement of the cutter members 59 about the axis 61A at different angles corresponding to distances of the units means 3 to 6 from the axis 30A for advancement of inclined straight and conical-shaped sections with relative movement of the units means 3 to 6 to the frame member 2 at different speeds of the working strokes of the rams means 12 to 15 according to distances of the units 3 to 6 from the axis 30A.

Since the set of the four units means 3 to 6 are capable of advancing continuously the constructing means 1 without the traction by the chassis means 19, so such constructing means is capable to comprise a plurality of the sets of such excavation-directing and making and side walls-forming, engaging and supporting units means connected to a frame member of an any intended working length with the ability to advance very deep excavation sections also without the traction by a chassis means. The number of the units means, their dimensions and the length of a frame member should be determined dependently on characteristics of the ground and the intended structure. A frame member is able to have an any intended thickness of 0.1 to 0.5 metres according to the intended characteristics of the structure, preferably 0.25 metres and the central surface of any intended polygonal, smooth curvilinear and rectilinear shapes. Such apparatus is capable to advance an excavation section round any obstacles such as poles, stubs, wells and the like, and along the length of an excavation line of any smooth shape, and to be used in construction of the underground structures of the depth up to fifteen meters, for instance, and of any desired smooth curvilinear contour, and at any desired transversal slope of the trench equal to about 45 to 135°, while the apparatus advances over and under the ground level and along a wall of a adit.

Figure 14:
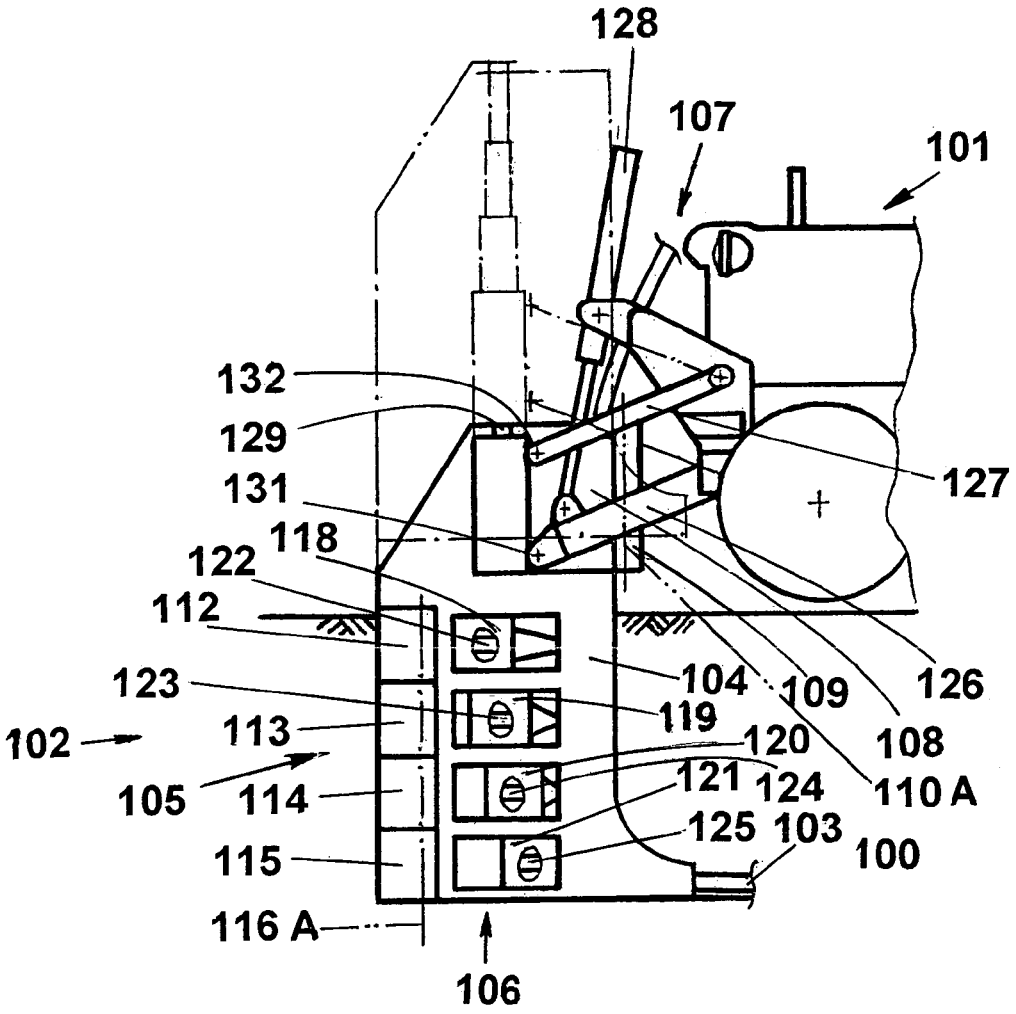
FIG. 14 is a side-view, partly in schematic form of a second simplified preferable embodiment of an apparatus for laying an electrical power cable into a curvilinear slit trench of the depth of 1.6 meters and the width of 12 centimetres in the ground that includes large and mainly ball-shaped boulders, according to the present invention.
Figure 15:
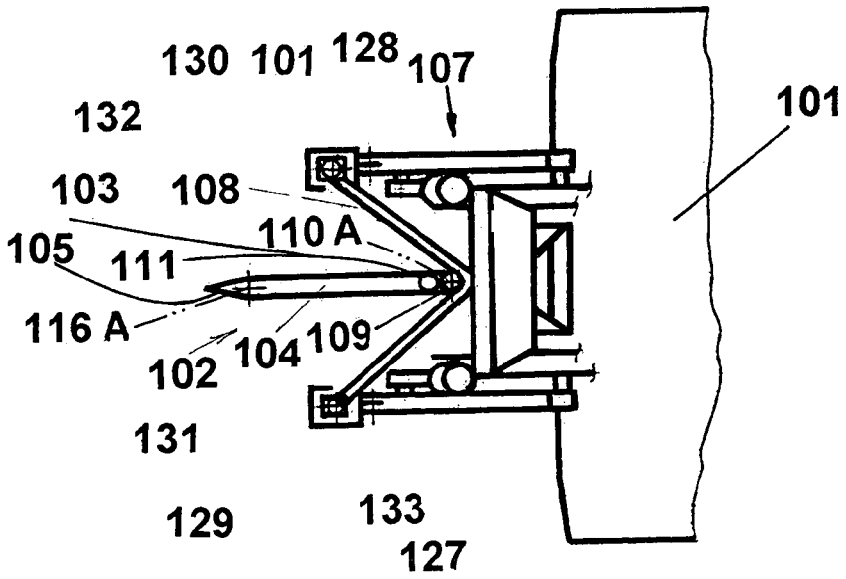
FIG. 15 is a plan view of the apparatus in FIG. 14.

A more simple apparatus for constructing an underground curvilinear and narrow horizontally extending electrical cable, and drain and supplying pipe line of the depth equal to about 1.6 meters in a slit trench being formed of the width of 12 centimetres, for instance, in the loamy ground that includes large and mainly ball-shaped boulders, the apparatus is shown in FIG. 14 and FIG. 15 and comprises a chassis means 101 such as a wheeled tractor supporting a means 102 for constructing the trench and laying the cable and supplying the length of the cable 103 and power to the constructing means 102, the chassis means 101 being movable in an intended advancing direction along the length of a cable line, the constructing means 102 comprising an elongate frame member 104 for guiding and supporting components of the constructing means 102, a means 105 for directing and making excavated sections to excavate sections ahead of the frame member 104 and force the frame member 104 from its position toward the intended advancing direction and control the direction of the advancement of the excavation, and a means 106 for forcing, forming, engaging, and supporting the side walls of the sections and is adapted to be disposed in working positions and extended into the ground up to a predetermined depth and distance toward and in the intended advancing direction to excavate, form, and support the side walls of an excavated section being formed along the length of the line to lay the length of the cable 103 into the excavated section, and a supporting framework means 107 mounted on the chassis means 101 and adapted to support the constructing means 102 on the chassis means 101 for vertical movement to raise the constructing means 102 into a transporting position and to lower into working positions and to shift the chassis means 101 to follow the constructing means 102 in the intended advancing direction, the framework means 107 comprises a carrier member 108 that is forced into engagement with the frame member 104 and adapted to connect the chassis means 101 and the constructing means 102 for movement.

The frame member 104 is engaged with the carrier member 108 by a pivotal connection 109 for movement about an axis 110A behind the constructing means 102, within the central longitudinal surface of the frame member 104 and the carrier member 108, and preferably perpendicular to the advancing direction and the road surface and has a cable-laying guide 111.

The directing and making means 105 is provided with a plurality, four, for example, of shortened excavation-directing and making members 112 to 115 that are corresponding to the characteristics of the ground and each spaced and supported by the frame member 104 for relative movement about an axis 116A between and within the central longitudinal axis of the frame member 104 and the making member 112 to 115 and perpendicular preferably to the advancing direction by a drive means 117 (not shown in FIG. 14 and FIG. 15).

The side walls-supporting means 106 adapted to advance continuously and securely the apparatus relative to the side walls and comprises a plurality, four for example, of side wall-forcing, forming, engaging and supporting units means 118 to 121 each supported on the frame member 104 for displacement in longitudinal direction and double-acting hydraulic rams means 122 to 125 to move longitudinally and separately each of the units means 118 to 121, which rams means 122 to 125 are pivotally secured at the rear to the frame member 104 and each connected via a thrust journal to a respective associated unit means 118 to 121.

Each of the means 104, and 112 to 115 and 118 to 121 is capable of being forced into interaction with the walls of the section being formed to urge the constructing means 102 in a direction crossing the central longitudinal axis of the excavated section toward the intended advancing direction and has excavation-directing portions for forcing the walls in the crossing direction, where the portions are operable to move the constructing means 102, with the means 104, 112 to 115, and 118 to 121 relative to the walls being forced toward the direction by an activating means of the apparatus capable of forcing the portions against the walls.

The directing and making members 112 to 115 have the ability to control the direction of the excavated section and the portions have the ability to control the force and direction of deformation of the working end facial wall of the excavated section being formed.

The directing and making members 112 to 115 are capable of forcing the facial wall in a direction crossing on the sides of the axis of turning advancement of the excavated section, and the chassis means 101 is adapted to be moved about the axis, where the carrier member 108 that is adapted to urge the chassis means 101 about the axis to follow the constructing means 102 while the excavated section is being advanced so that the direction of the transportation of the chassis means can be controlled.

Each of the making members 112 to 115 and the follower frame member 104 and the carrier member 108 are connected in consecutive order, relative to the advancing direction, for movement about the axes 116A and 110A preferably parallel mutually and perpendicular to the road surface and within the central longitudinal surfaces of the adjacent members 112 to 115, 104, and 108 with the ability to interact with the walls to urge the members in the lateral direction in the formation of the excavated section, where the excavation-directing portions are capable of deforming the ground to form the side walls into a cylindrical shape and are operated by the activating means to move the members about the axes 116A and 110A in order to move the members along the length of the section.

The framework means 107 comprises parallel pairs of forwardly extending and parallelogram-forming arm members 126 and 127, and activating double-acting rams means 128 for effecting lowering and raising the paired arm members 126 and 127, and actuated extension telescopic lifts means 129 supporting the carrier member 108 for vertical movement into working and transporting positions at the start, during and completion of each cable laying operation, and stops fixing the constructing means about the axis 110A in the transporting position (not shown). The forward ends of the paired arms 126 and 127 are pivotally connected to guiding and supporting frame members 130 of the lifts means 129 upon pairs of pins 131 and 132. The framework means 107 is with the ability to lean the chassis means 101 upon the frame member 104 lowered into the working position for advancement.

Figure 16:
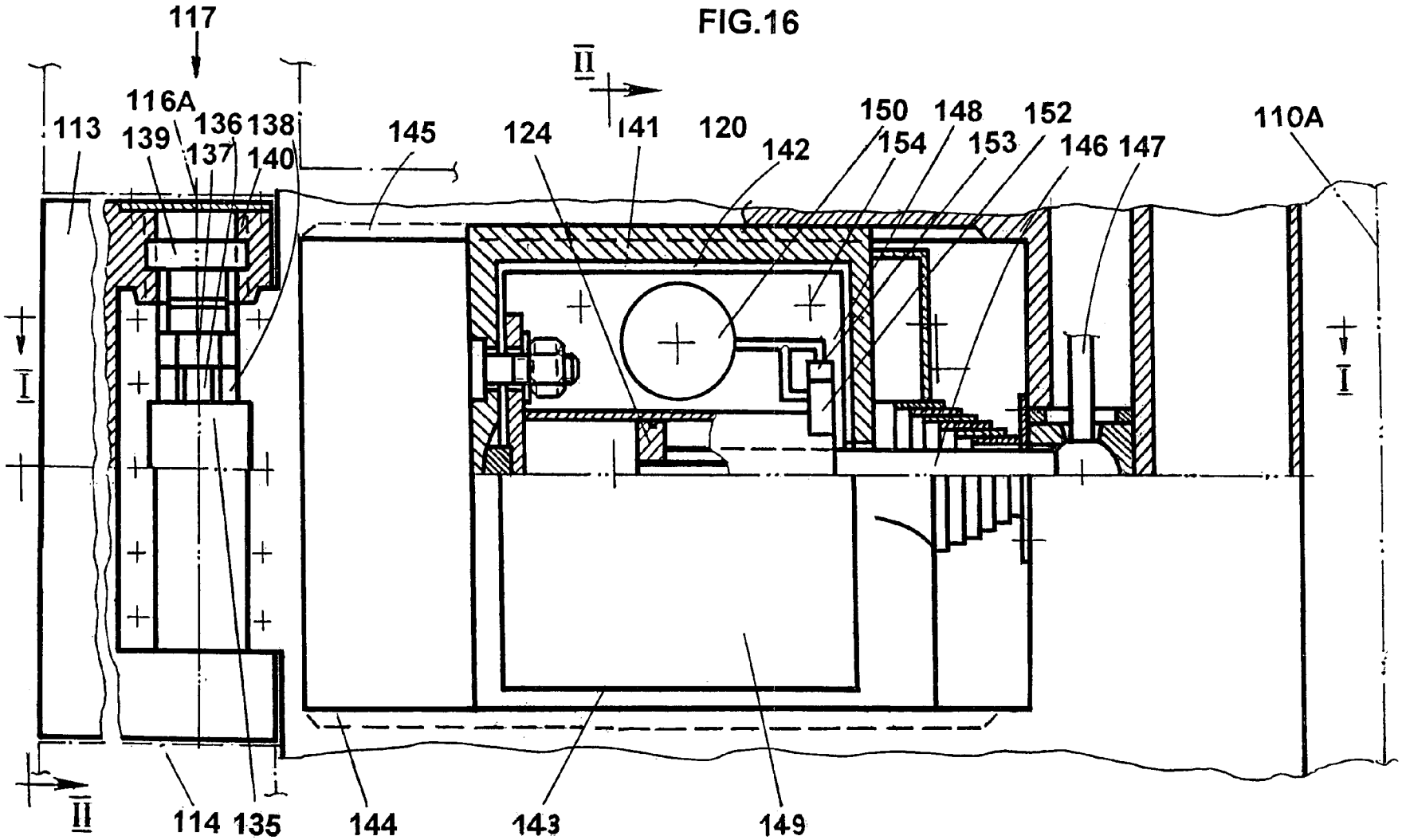
FIG. 16 is a side view and partly axial longitudinal vertical cross-sectional view of a constructing means 102 in FIG. 14 and FIG. 15.
Figure 17:
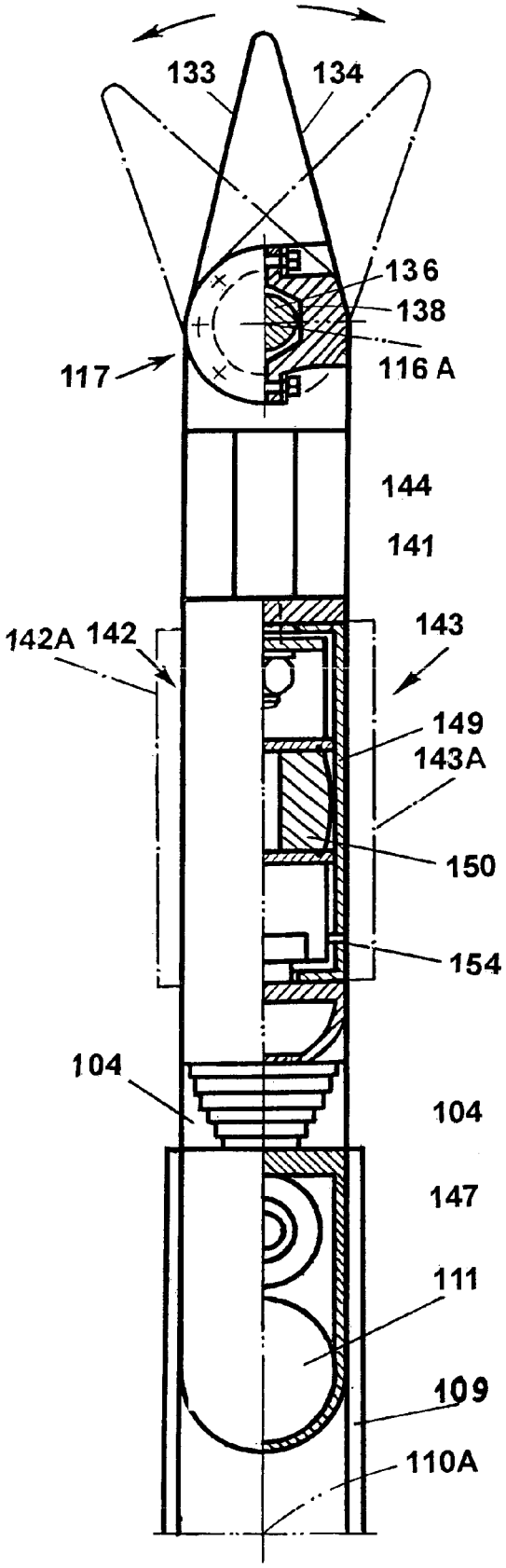
FIG. 17 is a plan view and partly cross-sectional view A-A of the constructing means 102 in FIG. 16.
Figure 18:
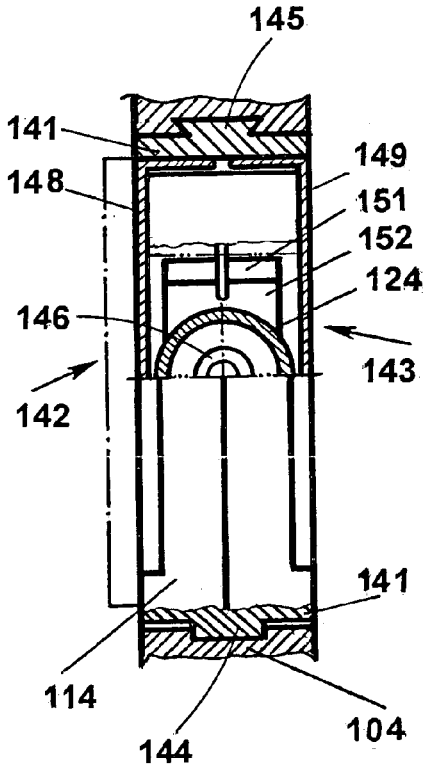
FIG. 18 is a front view and partly cross-sectional view B-B of the constructing means 102 in FIG. 16.

FIG. 16 to FIG. 18 show a section of the constructing means 102 comprising the directing and making member 114, for instance, that is similar to the rest sections comprising the making members 112, 113, and 115. The making member 114 comprises an oriented forward directing and making wedge-shaped making cutter member that corresponding to the ground including the boulders and has wedge-shaping making cutting portions 133 and 134, and the drive means 117 located within the excavated section to effect the relative movement about the axis 116A between the making member 114 and the supporting follower frame member 104. The making member 114 has the ability to be forced to move about the axis 116A of the frame member 104 and is adapted to urge the frame member 104 to move about the follower axis 110A of the carrier member 108.

The drive means 117 comprises a means 135 for providing motive power that having a piston and a double in opposite directions from the piston and displaceable along the axis 116A output rod 136 including castellated portions 137 leaning on corresponding castellated bearings of the support portion 138 of the frame member 104 for axial longitudinal displacement and for engaging screw-shaped splined portions 139 capable of interacting with corresponding engaged screw-shaped splined portions 140 of the making member 114.

The wedge-shaping portions 133 and 134 of the cutter members 112 to 115 are remotely located from the axis 110A of the movable connection of the frame member 104 and the carrier member 108 and are operable to move the frame member 104 about the axis 110A by the multiple activating means of the apparatus that capable of moving the constructing means 102 forward and the drive means 117 capable of rotating the making members 112 to 115 about the axis 116A relative to the frame member 104.

FIG. 16 to FIG. 18 show also the unit means 120 that is similar to the units means 118, 119, and 121 in FIG. 14. The unit means 120 comprises a frame member 141 for supporting components of the unit means 120 and opposite side wall-forcing, forming, engaging, and supporting members 142 and 143 having the ability to be forced against and into compressive engagement with the side wall and adapted to form and support the wall and urge the frame member 104 forward relative to the walls and connected to opposite slides 144 and 145 of the frame member 104 for movement in radial directions about the axis 110A by the ram means 124. Ends of the ram means 124 are capable to be connected separately to a means for supplying the pressure fluid (not shown) on the chassis means 101 through a co-axial piston rod member 146 and opposite pipe members 147 (second pipe member not shown). The unit means 120 is with the ability to be forced to advance turningly about the axis 110A toward the intended advancing direction and form the cylindrical-shaped walls and be expanded and outwardly forced into compressive engagement with the side walls being supported by the side wall-supporting members 142 and 143 to immobilise the supporting members 142 and 143 relative to the walls and be shrinked and inwardly forced out of the compressive engagement with the walls to easy advancement and has side wall-forming and supporting plates 148 and 149 reciprocatingly movable in transversal directions that are capable to compressively engage the walls of the excavated section and are operable to expand for immobilising the unit means 120 relative to the walls by an activating means such as two interacting hydraulic power rams means 150 and 151 capable to outwardly capable to outwardly move the plates 148 and 149 to engage compressively the walls and move the plates 148 and 149 relative to the adjacent supporting member 142 and 143 and connected hydraulically to the rod end of the ram means 124 through an usual suitable relief valve means 152 which is able to be open with fluid pressure more than the predetermined quantity of fluid pressure required for effecting movement together of the frame member 104 and the supporting members 142 and 143 and by an usual suitable check valve means 153, which is able to be open for reverse flow of pressure fluid from the rams means 150 and 151 toward the ram means 124 and closed for flow of the fluid toward the rams means 150 and 151, and by return spring members 154.

The continuous advancement of a curvilinear and narrow section of a slit trench used in the construction of an underground cable being realised by a method comprising the following steps:

(a) operating the activating means of the chassis means 101, the activating rams means 128, and the lifts means 129 of the framework 107 on the chassis means 101 of the apparatus for constructing the trench, the multiple activating means moves the means 102 for constructing the underground cable into a working position on a trench line;

(b) operating the activating means of the chassis means 101 and the constructing means 102 to insert the means 105 for directing and making the trench at the working position into the ground to a predetermined depth and distance in the excavation and in an intended advancing direction, so that the means for directing and making forms the section of the trench along the excavation line, the direction of the excavation diverges from the tangent of the central longitudinal axis of the section and is determined, (c) operating the activating means of the chassis means 101 and the constructing means 102 to insert into and move the supporting frame member 104 of the constructing means 102 in the excavated section along the tangent to cause the directing and making means 105 to excavate the section;

(d) operating the drive means 117 of the constructing means 102 to move the directing and making means 105 to force the ground of the working end facial wall of the excavated section at the directing and making means 105 in a direction opposite to the diverged direction to cause to be forced toward the diverged direction and force the frame member 104 to form the side wells at the frame member 104 toward the diverged direction so to advance the trench in the diverged direction to evacuate the section and the length of the cable to be let into the excavated and evacuated section, where the drive means 117 is located within the section that is formed by forces applied to the walls of the section by the directing and making means 105 and the frame member 104;

(e) operating the rams means 122 to 125 of the constructing means 102 to advance the side wall-forming and supporting units means 118 to 121 of the means 106 for forming and supporting the side walls, the means 106 being part of the constructing means 102, turningly about the axis 110A of connection 109 the frame member 104 and the carrier member 108 toward and in the diverged direction and stop in advanced positions within the excavated section to form and support the walls, (f) operating activating rams means 150 and 151 of the forming and supporting members 142 and 143 of the forming and supporting means 106 to move wall-forming and supporting plates 148 and 149 of the stopped forming and supporting members 142 and 143 outwardly in opposite directions against and to form the walls of the section;

(g) operating the activating rams means 128 and the lifts means 129 of the framework 107 to lean the forward part of the chassis means 101 upon the frame member 104 so to keep the constructing means 102 in the intended working depth;

(h) operating the activating rams means 122 to 125 of the constructing means 102 to move the frame member 104 about and relative to the axis 110A of the carrier member 108 in the advancing turning direction at a speed, $V_1$, where the speed must be equal to a speed of turning the constructing means 102 in the same direction by the activating means of the chassis means 101 to cause the constructing means 102 to decrease the traction by and the overturning moment about the chassis means 101, and where the speed $V_1$ of the continuous uniform turning the frame member relative to the forming and supporting means is secured by operating the activating means of the constructing means to effect the alternate uninterruptible turning in the opposite directions between the frame member and each of the side walls forming and supporting members, n, with the same preferably distances and speeds, $V_2$, where the speeds must be equal to no less than about $(0.5n-1)\times V_1$ relative to the frame member, and $0.5n\times V1$ relative to the ground.

The method further comprises stopping the constructing means 102 by the multiple activating means of the apparatus right away when the constructing means 102 accidentally runs against a buried obstacle, and remotely exploring a position, shape, and dimensions of the buried obstacle by a well-known suitable measuring means to determine when to operate the multiple activating means to effect further advancement of the section, and selectively operating the multiple activating means of the apparatus in accordance with results of the measuring means.

The apparatus is especially useful in unstable grounds of a rough country that are difficult for crossing, such as a hover and loose, moist, moody and clayey, watered and waterlogged ground that includes large boulders. An important advantage of the apparatus in addition to the cancelled draft forces required is the relative smooth compressed condition of the side walls of the trench. Since the walls are tightly compacted, the earth will have little tendency to fall to the bottom of the trench. Accordingly, the cable can be reliable laid in a variety of different kinds of ground at a constant depth since there is little tendency for falling earth to accumulate periodically in piles at the bottom of the trench. Another important benefits obtained through the use of the apparatus is the ability of the constructing means to clear obstacles such as boulders and rocks, It is believed to be due to the tendency for the forward wedge-shaping portions of the cutter member when contacting a boulder located, for example, on its left side to force the supporting frame member toward the right as the forward portion of the cutter moves forward with the frame member by the rams means of the constructing means. The frame member being supported on the side wall-supporting members being supported on the compressed side walls so the frame member tends to remain moving rectilinearly as the wedge-shaping portion of the cutter moves the boulder to the left. In this way the cutter and the entire apparatus tends to work its way around the boulder. The constructing means is with the ability to advance turningly around the very large insurmountable boulder and rock. The apparatus has no tendency to damage or kink cables and the large radius of the rearward edge of the guide will subject the cable to a minimum of stress as it is laid.

For brevity the term "material" is used in the claims as the material to be laid, and it is to be understood that this term is intended to encompass a conduit such as electrical cable for electrical current, signals, sounds, or light as well as pipe for flow of water or other liquid, and a hardening liquid such as cement milk mixed with bentonite, earth or sand to form a soil-cement wall.

The sizes of the constructing means should be sufficient to construct an intended underground structure. In a typical cable or pipe laying operation the depth of laying will usually be from 0.8 meter up to about 4.0 meters with about 1.6 meter being typical, the width of a slit trench will usually be from 6 centimeters up to 20 centimeters with about 12 centimeters being typical. In a typical underground wall constructing operation the depth of constructing will usually be from 2 meters up to about 25 meters with about 10 meters being typical.

Figure 19:
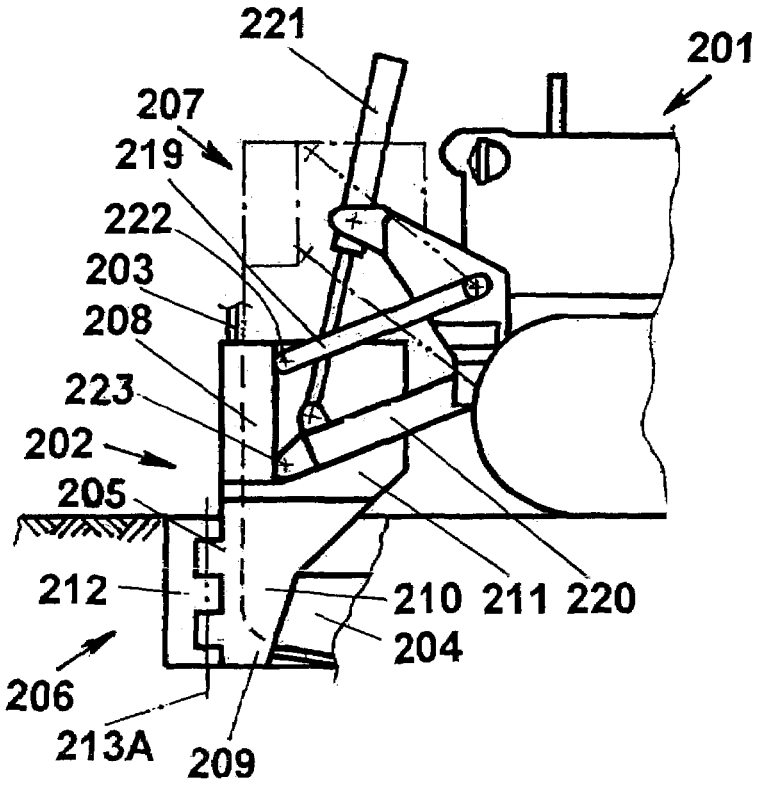
FIG. 19 is a side-view, partly in schematic form of an embodiment of the apparatus in FIG. 14 and FIG. 15, the apparatus adapted for constructing a rectilinear slit trench in an unstable ground.
Figure 20:
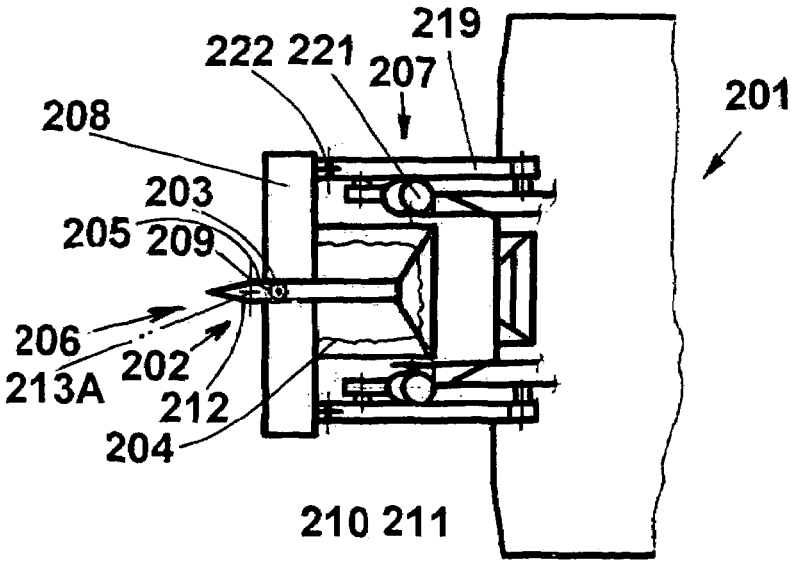
FIG. 20 is a plan view of the apparatus in FIG. 19.

A third preferred embodiment of an apparatus for constructing an underground curvilinear and narrow horizontally extending structure such as a drain pipe line and granular filling for intercepting and collecting surface water in an excavation such as a slit trench being formed of the depth equal to about 0.8 meter and the width equal to about 12 centimeters, for instance in the clayey ground, that includes large and mainly ball-shaped boulders, the apparatus is shown in FIG. 19 and FIG. 20 and comprises a chassis means 201 such as a caterpillar tractor supporting a means 202 for constructing the underground drain and supplying a length of the drain pipe 203, a volume of granular loose material 204 and power to the constructing means 202, the chassis means 201 being movable along the length of an intercepting drain pipe line, where the constructing means 202 comprises an elongate frame member 205 for guiding and supporting components of the constructing means 202, a means 206 for directing and making excavated sections to excavate trench sections ahead of the frame member 205 and force the frame member 205 from its position toward the intended advancing direction and control the direction of the advancement of the trench, and is adapted to be disposed in working positions and extended into the ground up to a predetermined depth and distance toward and in the intended advancing direction to excavate and form the side walls of an excavated section being formed along the length of the line to lay the length of the drain pipe 203 and the volume of the granular material 204 into the excavated section, and a supporting framework means 207 mounted on the chassis means 201 and adapted to support the constructing means 202 on the chassis means 201 for vertical movement to raise the constructing means 202 into a transporting position and to lower into working positions, the framework means 207 comprises a carrier member 208 that is forced into engagement with the frame member 205 and adapted to connect the chassis means 201 and the constructing means 202 for movement.

The frame member 205 is engaged securely to the carrier member 208 and has a pipe-laying guide 209 and a guide 210 for laying the granular material being supplied from a bunker 211 supported on the frame member 205.

The directing and making means 206 is provided with an excavation-directing and making member 212 corresponding to the characteristics of the ground that includes the boulders and having a forward-oriented wedge shape and supported by the frame member 205 for relative movement about an axis 213A between and within the central longitudinal axis of the frame member 205 and the making member 212 and perpendicular preferably to the advancing direction and the road surface and a drive means 214 (not shown in FIG. 19 and FIG. 20) for effecting the turning movement.

Each of the members 205 and 212 is capable of being forced into interaction with the walls of the section being formed to urge the constructing means 202 in a direction crossing the central longitudinal axis of the excavated section toward the intended advancing direction and has excavation-directing wedge-shaping portions 215 and 216 and plates 217 and 218 for forcing the walls in the crossing direction, where the portions are operable to move the constructing means 202, with the members 205 and 212 relative to the walls being forced toward the direction by an activating means of the apparatus capable of forcing the portions against the walls. The member 212 has the ability to control the direction of the excavated section and the portions 215 and 216 have the ability to control the force and direction of deformation of the working end facial wall of the excavated section being formed.

The member 212 is capable of forcing the facial wall in a direction crossing on the sides of the axis of turning advancement of the excavated section, and the chassis means 201 is adapted to be moved about the axis, where the carrier member 208 that is adapted to urge the chassis means 201 about the axis to follow the constructing means 202 while the excavated section is being advanced so that the direction of the transportation of the chassis means 201 can be controlled.

The member 212 and the frame member 205 are with the ability to interact with the walls to urge the members 212 and 205 in the lateral direction in the formation of the excavated section, where the excavation-directing portions 215 and 216 are capable of deforming the ground to form the side walls into a cylindrical shape and are operated by the activating means to move the member 212 about the axis 213A in order to move the members along the length of the section.

The framework means 207 comprises parallel pairs of forwardly extending and parallelogram-forming well-known arm members 219 and 220, and activating double-acting rams means 221 for effecting lowering and raising the paired arm members 219 and 220 for vertical movement of the constructing means 202 into working and transporting positions at the start, during and completion of each intercepting drain laying operation. The forward ends of the paired arm members 219 and 220 are pivotally about transversal axes connected to the carrier member 208 upon pairs of pins 222 and 223.

Figure 21:
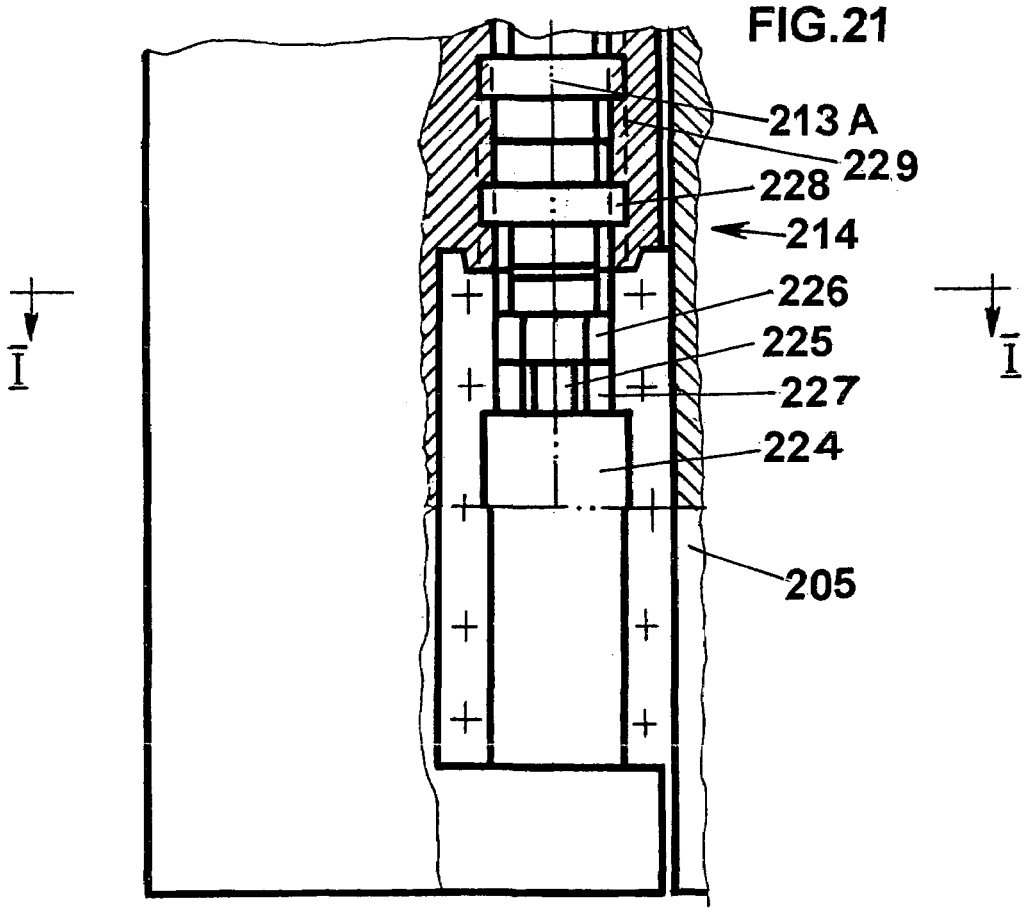
FIG. 21 is a side-view, partly in schematic form of a third simplest preferable embodiment of an apparatus for constructing a curvilinear pipe line and granular filling for intercepting and collecting surface flow water in a slit french of the depth of 0.8 meter and the width of 12 centimetres in a clayey ground that includes large and mainly ball-shaped boulders according to the present invention.
Figure 22:
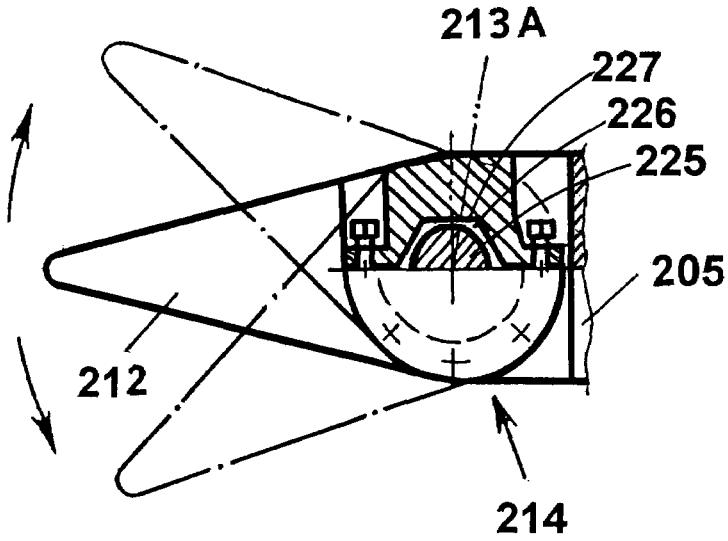
FIG. 22 is a plan view of the apparatus in FIG. 21.

FIG. 21 and FIG. 22 show a section of the constructing means 202 comprising the directing and making member 212 and the drive means 214 located within the excavated section to effect the relative movement about the axis 213A between the making member 212 and the frame member 205. The member 212 has the ability to be forced to move about the axis 213A of the frame member 205 and is adapted to urge the frame member 205 to move about the axis of turning advancement of the slit trench.

The drive means 214 comprises a means 224 for providing motive power that having a piston and a double in opposite directions from the piston and displaceable along the axis 213A output rod 225 including castellated portions 226 leaning on corresponding castellated bearings of the support portion 227 of the frame member 205 for axial longitudinal displacement and for engaging screw-shaped splined portions 228 capable of interacting with corresponding engaged screw-shaped splined portions 229 of the making member 212.

The portions 215 and 216 of the cutter member 212 are remotely located from the centre of the turning advancement of the chassis means 201 and are operable to move the frame member 205, the carrier member 208, and the chassis means 201 about the centre by the multiple activating means of the apparatus that capable of moving the constructing means 202 forward and the drive means 214 capable of rotating the making member 212 about the axis 213A relative to the frame member 205.

The advancement of a curvilinear and narrow section of a slit trench used in the construction of an underground intercepting drain line being realised by a method comprising the following steps:

(a) operating the activating means of the chassis means 201 and the activating rams means 219 of the framework 207 on the chassis means 201 to move the constructing means 202 into a working position on a trench line;

(b) operating the activating means of the chassis means 201 to insert the means 206 for directing and making the trench at the working position into the ground to a predetermined depth and distance in the excavation and in an intended advancing direction, so that the means for directing and making forms the section of the trench along the excavation line, the direction of the excavation diverges from the tangent of the central longitudinal axis of the section and is determined, (c) operating the activating means of the chassis means 201 to insert into and move the supporting frame member 205 of the constructing means 202 in the excavated section along the tangent to cause the directing and making means 206 to excavate the section;

(d) operating the drive means 214 of the constructing means 202 to move the directing and making means 206 to force continuously the ground of the working end facial wall of the excavated section at the directing and making means 206 in a direction opposite to the diverged direction to cause the making means 206 to be forced continuously relative to the wall toward the diverged direction and force continuously the frame member 205 to form the cylindrical-shaped side walls at the frame member 205 toward the diverged direction so to advance the trench toward and in the diverged direction, evacuate the section, and the length of the drain pipe and a volume of granulated material to be let into the excavated and evacuated section, where the drive means 214 is located within the section that is formed by forces applied continuously to the walls of the section by the directing and making means 206 and the frame member 205.

The method further comprises stopping the constructing means 202 by the multiple activating means of the apparatus right away when the constructing means 202 accidentally runs against a buried obstacle, and remotely exploring a position, shape, and dimensions of the buried obstacle by a well-known suitable measuring means to determine when to operate the multiple activating means to effect further advancement of the section, and selectively operating the multiple activating means of the apparatus in accordance with results of the measuring means.

The apparatus is especially useful for constructing intercepting and collecting drains of a drain pipe of the diameter 4-5 centimeters and very permeable granular loose filling material along the horizontals of the ground surface in weak-permeable ground being flooded with flowing surface water. It may be also useful for laying a cable and supplying pipe of the diameter up to about 16 centimeters.

The wedge-shaping angle of the wedge-shaped cutter should be equal from about 25°-60° with about 30° being typical, the size of the arc through which the wedge-shaped cutter turns is not considered critical but in general the characteristics of the screw-shaped portions and the strike of the motive output rod should be sufficient to rotate the wedge-shaped cutter from the full left position to the full right position a total angle that should be equal up to 60° so the angle between the advancing direction and the forward wedge-shaping portion should be not more than 45°.

The wedge-shaping angle of the wedge-shaped cutter should be equal from about 25-60 with about 30 being typical, the size of the arc through which the wedge-shaped cutter turns is not considered critical but in general the characteristics of the screw-shaped portions and the strike of the motive output rod should be sufficient to rotate the wedge-shaped cutter from the full left position to the full right position a total angle that should be equal up to 60° so the angle between the advancing direction and the forward oriented wedge-shaping portion should be not more than 45°.

The sizes of side wall-supporting members should be sufficient to support the side walls against collapse and create an intended traction for movement of the constructing means and advancement of the apparatus.

For brevity the term "an intended advancing direction" is used in the claims as the direction to be gone, and it is to be understood that this term is intended to encompass a horizontal direction of extending of an underground structure such as cable and pipe; and horizontal, inclined, and vertical preferably anchor, foundation, diaphragm, and drain stratum and wall; and an inclined and vertical preferably direction of extending of an anchor and foundation pile, column, and wall; and drain and supplying well.

Accordingly, the term "a chassis means" is to be understood that this term is intended to encompass a caterpillar and wheeled tractor, trailer, track, and trolley; and the term "a framework means" is intended to encompass a slit and slot trencher, and a pile driver.

It is apparent that the invention may be employed in many configurations, modifications and variations other than the specific forms and embodiments are described and given hereinbefore by way of example only without departing from the essential scope, spirit, and substance thereof and the scope of the invention is defined and limited only by the terms of the appended. Claims, including also all subject matter encompassed by the doctrine of equivalents as applicable to the claims.

We claim as our invention:

1. An apparatus for constructing an underground curvilinear and horizontally extending structure in a slit trench-shaped excavation being formed in the ground that includes large and mainly ball-shaped boulders, the apparatus comprises:

a chassis means supporting a means for constructing the structure and supplying power and materials to said structure constructing means, where the chassis means being movable along the length of a structure line, the constructing means comprising an elongate frame member for guiding and supporting components of the constructing means and a means for making excavate sections to excavate sections ahead of the frame member and a means for directing the excavation that being able to force the frame member from its position toward the intended advancing direction and control the direction of the advancement of the excavation and being adapted to be disposed in working positions and extended into the ground up to a predetermined depth toward and in the intended advancing direction to excavate, form, and support the side walls of an excavated section being formed along the length of the structure line to lay the materials into the excavated section;

a connecting framework mounted on the chassis means and adapted to connect the constructing means to the chassis means and to dispose and advance the constructing means in an intended advancing direction, the framework comprises a carrier member that being forced into engagement with the frame member of the constructing means;

a means for measuring the position, shape, and dimensions of the boulders and determining when to operate multiple activating means to effect further advancement of the section.

2. The apparatus according to claim 1, wherein the excavation-directing means comprises a plurality of excavation-directing members, where each of the members is capable of being forced into interaction with the walls of the section being formed to urge the constructing means in a direction crossing the central longitudinal axis of the excavated section toward the intended advancing direction and has excavation-directing portions for forcing the walls in the crossing direction, where the portions are operable to move the constructing means, with the directing members, relative to the walls being forced toward the direction by an activating means capable of forcing the portions against the walls.

3. The apparatus according to claim 2, wherein several of the excavation-directing members have the ability to control the direction of the excavated section and the portions have the ability to control the force and direction of deformation of the working end facial wall of the excavated section being formed.

4. The apparatus according to claim 3, wherein the constructing means is provided with vertically disposed excavation-directing and making members capable of forcing the facial wall in a direction crossing on the sides of an axis of turning advancement of the chassis means along the curvilinear excavated section, the chassis means is adapted to be moved about the turning axis, where the carrier member that is disposed remotely from the turning axis and adapted to urge the chassis means about the turning axis to follow the constructing means while the excavated section is being advanced so that the direction of the transportation of the chassis means can be controlled.

5. The apparatus according to claim 4, wherein the excavation-making members and follower members are connected in consecutive order, relative to the advancing direction, for movement about connecting axes on the central longitudinal surface of the adjacent members and perpendicular to the direction of advancement of the members with the ability to interact with the walls to urge the members in the lateral direction in the formation of the excavated section, where the making and directing portions are capable of deforming the ground to form the side walls in a cylindrical shape and are operated by the activating means to move the members about the connecting axes in order to move the members along the length of the section.

6. The apparatus according to claim 5, wherein the excavation-making members have forward oriented, angle-shaping cutting portions, each of the making members comprises a drive means located within the excavated section to effect the relative movement of the connecting axis between the directing member and the follower members.

7. The apparatus according to claim 6, wherein the excavation-making member comprises a directing wedge-shaped cutter member connected to the frame member for movement about a connecting axis on the central longitudinal surfaces of and transverse to the direction of advancement of the cutter member and the support frame member; the making members have the ability to be forced to move about the connecting axis of the frame member and are adapted to urge the frame member to move about an axis of a movable connection of the frame member and the carrier member.

8. The apparatus according to claim 6, wherein the wedge-shaped portions of the cutter member are remotely located from the axis of the movable connection of the frame member and the carrier member and are operable to move the frame member about the connecting axis of the carrier member by the second activating means that is capable of moving the constructing means forward and by the drive means that is capable of rotating the cutter member relative to the frame member.

9. The apparatus according to claim 8, wherein the drive means comprises a means for providing motive power having a longitudinal displaceable output rod and including castellated portions leaning on corresponding castellated bearings of the support member for axial longitudinal displacement and for engaging screw-shaped splined portions capable of interacting with corresponding engaged screw-shaped splined portions of the excavation making members.

10. The apparatus according to claim 5, wherein several of the follower members are relatively movable in a direction crossing the central longitudinal surfaces of the front and next follower members toward the intended advancing direction, the next member is supporting the front member, and a third activating means effects the movement between the front member and the next members about the transversal axis to form the cylindrical-shaped side walls to advance the excavated section.

11. The apparatus according to claim 10, wherein the follower members are capable of supporting and forcing the walls in a direction crossing on the sides of an axis of turning advancement of the chassis means and adapted to urge the chassis means to move about the turning axis, where the next follower member is connected to the carrier member for turning advancement of the chassis means to transport the chassis means in the advancing direction, the connection is made remotely from and ahead of the turning axis; the carrier member is operable to urge the chassis means to follow the next follower member relative to the side walls at the speed equal to the speed of advancement of the next member with the carrier member to decrease the overturning moment and the thrust on the chassis means.

12. The apparatus according to claim 11, wherein the side wall-supporting members have the ability to be expanded and outwardly forced into compressive engagement with the side walls being supported by the member to immobilize the side wall-supporting member relative to the walls.

13. The apparatus according to claim 12, wherein the side wall-supporting members have side wall-supporting plates reciprocatingly movable in transversal direction that are capable to compressively engage the walls of the excavated section and are operable to expand the supporting member for immobilizing the member relative to the walls by a forth activating means capable to outwardly move the plates to engage the walls and move the plates relative to the adjacent supporting member.

14. The apparatus according to claim 10, wherein the front follower member and the next follower member comprises another follower member connected to the next member for movement about an axis on the central longitudinal surfaces of the front member and the next member and perpendicular to the direction crossing the central longitudinal surface of the next member and to the front member for radial movement and to hold the front member oriented in the radial direction about the perpendicular axis; a third activating means effects the movement between the front member and the next member about the axis.

15. The apparatus according to claim 14, wherein the cutter member and the front follower member consist of a plurality of shortened units for controlling the direction of the excavation, compressing the side walls, forming and supporting cylindrically-shaped side walls, where the units are multistorily disposed, where each of the units includes a direction-controlling cutter member that are compressively engaged with the side walls and a supporting member that is movable relative to a first axis on the central longitudinal surface of the making member and the followed member, where the support member is connected to a separate follower member to allow reciprocating movement in radial directions about a second axis relative to the frame member, the movement being caused by an activating means of the units, and is capable of moving the follower member about the second axis behind one of the units on the central longitudinal surfaces of the follower member, the frame member, and the support member and generally transversal to the direction of reciprocating movement between the frame member and the support member with the ability to be separately rotated by the making member relative to the frame member in a diverged relation to other units in a radial direction to separately form and support the cylindrical-shaped walls and effect movement between the frame member and the carrier member about a third axis to effect the turning advancement of the excavated section in a diverged direction and past an obstacle.

16. The apparatus according to claim 15, wherein each of the follower members is connected with the frame member for movement about the second axis and adapted to hold the unit in the radial direction about the second axis and to locate a position of the unit relative to the frame member and is connected to each of the adjacent follower members between by a catch lock that is adapted to be broken by a buried obstacle of a predetermined size.

17. The apparatus according to claim 15, wherein each of the units comprises a wedge-shaped cutter member and a drive means for effecting the movement between the cutter member and the support member about the first axis to effect the movement between the units and the frame member about the second axis and excavated section.

18. The apparatus according to claim 15, wherein the activating means of the units is capable of moving the constructing means about the axis of the connection of the constructing means and the carrier member into intended positions in the ground at speeds according to the locations of each of the units along the length of the underground portion of the frame member.

19. The apparatus according to claim 18, wherein the multiple activating means are capable of simultaneously effecting uninterruptible movements together between the frame member and the intended number of the units ahead of the frame member and stationary relative to the walls at the speed $V_1$, where the speed $V_1$ is the speed of continuous uniform movement of the frame member in the same direction with the chassis means and alternate and uninteruptible movement in opposite directions between the frame member and each of the units alternately approaching the frame member at the same speeds $V_2$ and distances relative to the frame member, where the speed $V_2$ must be equal to not less than about "$(n-1)\times V_1$" in relation to the frame member and "$n\times V_1$" in relation to the ground where "n" is the number of the units.

20. The apparatus according to claim 5, wherein a follower member is provided with a number of excavation side wall-supporting members multistorily distributed within an elongated underground portion of the follower member and along radiuses about axes of the connection of the constructing means and the carrier member and advanceable in a direction crossing the radiuses, the follower member is able to support and guide the supporting members for displacement, and a fourth activating means for effecting relative movement between the supporting members and the follower member about the axes into intended positions in the ground at speeds according to the locations of each of the supporting members along the length of the underground portion of the follower member.

21. The apparatus according to claim 4, wherein the carrier member is adapted to move the chassis means to follow an adjacent support member.

22. The apparatus according to claim 21, wherein the carrier member is operated by an activating means that is capable of moving front support members backward to a next support member and by an activating drive means capable of rotating cutter members relative to the front support member.

23. The apparatus according to claim 21, wherein the next support member is connected to the framework means for movement about a direct axis, a transversal axis, and a vertical axis.

24. The apparatus according to claim 23, wherein the movement of the frame member about the direct, transversal and perpendicular axes is allowable by catch locks of the framework that are disposed between the frame member and the framework means and adapted to be broken by a buried obstacle of a predetermined size the apparatus comes across in the ground.

25. A method for advancement of a curvilinear section of an excavation used in the construction of an underground structure, the method comprising the following steps:

operating an activating means of an apparatus for constructing the excavation, the activating means advances a movable chassis means along an excavation line and inserts a means for making the excavation, the means for making being part of a means for constructing the underground structure, at a working position into the ground to a predetermined depth in the excavation and in an intended advancing direction so that the means for making forms the section of the excavation along the excavation line, the direction of the excavation diverges from the central longitudinal axis of the section and is determined, operating the activating means to move a guiding and supporting frame member of the constructing means in the intended advancing direction to cause the frame member to excavate the section and materials of the structure to be let into the excavated section;

operating a second activating means to insert and move a means for directing the excavation in a working position to force the ground at the directing means in a direction opposite to the diverged direction to cause the directing means and the frame member to be forced in the diverged direction so to advance the excavation in the diverged direction; and remotely exploring a position, shape, and dimensions of a buried obstacle the apparatus comes across in the ground by a well-known suitable measuring means to determine when to operate the multiple activating means to effect further advancement of the section.

26. The method according to claim 25, wherein the activating means of the constructing means and directing means are located within the section that is formed by forces applied to walls of the section and the frame member by the directing means.

27. The method according to claim 25, further comprising the following step operating the activating means of the apparatus to stop the constructing means right away when the constructing means accidentally runs against the buried obstacle.

28. The method according to claim 25, wherein the second activating means is selectively operated in accordance with results of the measuring means.

29. The method according to claim 25, further comprising the following steps:

operating the activating means of the constructing means to advance a means for supporting the side walls of the excavation relative to the frame member and to stop within the formed section to support the walls, where the means for supporting being part of the constructing means;

operating an activating means of the supporting means to move wall-supporting portions of the stopped supporting means outwardly in opposite directions against and into compressive engagement with the walls of the section to immobilize the supporting means relative to the walls; and operating the activating means of the constructing means to move the frame member relative to the supporting means in the advancing direction at a speed, $V_1$, where the speed must be equal to a speed of movement of the constructing means in the same direction with the chassis means to cause the constructing means to decrease the traction by and the overturning moment about the chassis means.

30. The method according to claim 29, wherein the speed $V_1$ of the continuous uniform movement of the frame member relative to the supporting means is secured by operating the activating means of the constructing means to effect the alternate longitudinal uninterruptible movement in the opposite directions between the frame member and each of the opposite side walls supporting members, n, with the same distances and speeds, $V_2$, relative to the frame member, where the speeds must be equal to no less than about $V_2=(n-1)\times V_1$.

31. An apparatus for constructing an underground horizontally extending structure in a trench being formed in the ground, the apparatus comprising an advanceable trench-forming means for excavating the trench in a direction and for supporting the side walls thereof, the trench-forming means being composed of a plurality of side wall-supporting members displaceable in the direction for supporting and guiding the members and an activating means for effecting relative movement between the frame and the members to effect advancement of the trench, wherein each of the members has the ability to be changed in its volume and outwardly forced into compressive engagement with the side walls being supported by the member to easy the movement of the forming means within the trench, where the members have side wall-supporting plates reciprocatingly movable in transversal direction that are capable to compressively engage the walls of an excavated section of the trench and are operable to change the member in its volume by a second activating means capable to outwardly move the plates against the walls and move the plates relative to the frame and the adjacent member.

32. A method for continuous advancement of a section of a trench used in the construction of an underground structure, the method using an apparatus for constructing the structure, the apparatus being composed of a framework adapted to be transported in a direction over the ground to produce a trench, the trench extends in that direction, and a means for forming the trench, the forming means is adapted to extend from the framework down into the ground and comprises a plurality of in that direction displaceable members for supporting side walls of excavated sections of the trench, a frame for supporting and guiding the members, the frame is supported by the framework, and an activating means for effecting relative movement between the frame and the members to effect advancement of the trench, the method comprising the steps of:

operating an activating means of an apparatus for constructing the trench, the activating means advances the framework along an excavation line and inserts a means for making the trench, the means for making being part of the forming means, at a working position into the around to a predetermined depth in the trench and in the direction so that the means for making forms the section of the trench along the excavation line;

operating the activating means to move a guiding and supporting frame of the forming means in the direction to cause the frame to excavate the section and materials of the structure to be let into the excavated section;

operating an activating means of the forming means to insert and advance a means for supporting side walls of tile section in a working position relative to the frame and to stop within the formed section to support the walls, where the means for supporting being part of the forming means;

operating the activating means of the forming means to move the frame relative to the supporting members in the advancing direction at a speed $V_1$, wherein the speed must be equal to a speed of continuous uniform movement of the frame in the same direction with the framework to cause the forming means to decrease the traction by and the overturning moment about the framework, and where the speed $V_1$ of the continuous uniform movement of the frame relative to the members is secured by operating the activating means of the forming means to effect the alternate longitudinal uninteruptible movement in opposite directions between the frame and each of the members, n, with the same preferably distances and speeds, $V_2$, relative to the frame, where the speed $V_2$ must be equal to not less than about "$V_2=(0,5n-1)\times V_1$" relative to the frame and "$0,5n\times V_1$" relative to the ground.

33. An apparatus for constructing an underground curvilinear and horizontally extending structure in a trench being formed in the ground, the apparatus comprises:

a chassis supporting a means for forming the structure and supplying power and materials to the structure-forming means, the chassis being movable in an intended advancing direction along the length of a structure line;

a connecting framework mounted on the chassis and adapted to connect the chassis to the forming means and to dispose and advance the forming means in the direction;

the forming means comprising a for supporting components of the forming means, a means for making excavated sections to excavate sections ahead of the frame and a means for supporting the side walls of the excavated sections and adapted to be disposed in working positions and extended into the ground up to a predetermined depth and distance toward and in the intended advancing direction to excavate, form and support the side walls of an excavated section being formed along the length of the line to lay the materials into the excavated section;

where the excavation-making means and walls-supporting means comprise a number of multistorily disposed units for controlling the direction of the excavation, forming and supporting cylindrically-shaped side walls, each of the units comprises a direction-controlling and section-making member and section walls-supporting member that being reciprocatingly movable forward and backward relative to the advancing direction and to the frame, and an activating means for effecting relative movement between the frame and each of the units to effect advancement of the trench, wherein each of the units is connected to the frame for movement about a pivot axis, the pivot axis being on a central longitudinal surface of the frame and transversal to the directions of the movement, and is capable of be forced to turn from its position laterally leftward and rightward about the pivot axis and aside relative to the frame toward the intended advancing direction adapted to control the direction of the advancement of the trench.

34. The apparatus defined in claim 33, wherein the forming means comprises the number of members for supporting and guiding the units for radial movement about the pivot axis, where the guiding members are connected to the frame for movement about the pivot axis.

35. The apparatus defined in claim 33, wherein each of the excavation-making members comprises a wedge-shaped cutter connected to the wall-supporting member of the unit for movement about a front pivot axis, the front axis being on a central longitudinal plane of the supporting member remotely ahead of the pivot axis of the frame and transversal to the directions of its advancement, the cutter is capable to be forced to turn laterally leftward and rightward about the front axis and aside relative to the support member to urge the support member and the guiding member to turn laterally leftward and rightward about the second axis and aside relative to the frame.

36. The apparatus defined in claim 35, wherein each of the cutters comprises forward oriented, angle-shaping cutting portions for forcing the working end facial wall of the excavated section being formed, the cutting portions are remotely from the second axis and are operable to turn the unit laterally leftward and rightward about the second axis and relative to the frame by an activating means of the apparatus capable of forcing the unit forward.

37. The apparatus defined in claim 33, wherein the frame member is connected to a carrier member of the framework for movement about a direct axis, a transverse axis, and a vertical axis and is adapted to move the chassis.

38. The apparatus defined in claim 33, wherein each of the side wall-supporting members that has the ability to be changed in its volume and being operable to easy the movement of the forming means within the trench.

39. The apparatus defined in claim 33, wherein each of the supporting members has side wall-supporting plates reciprocatingly movable in transversal directions and operable to change the supporting member in volume by an multiple activating means capable of effecting simultaneously uninterruptible movements together between the frame member and the intended number of the supporting members stationary relative to the walls at the speed $V_1$, where the speed $V_1$ is the speed of continuous uniform movement of the frame member in the same direction with the framework means, and alternately and uninteruptible movement in opposite directions between the frame member and each of the supporting members alternately approaching the end of the working stroke of the ram means at the same speeds $V_2$ and distances relative to the frame member, where the speed $V_2$ must be equal to not less than about "$(0,5n-1)\times V_1$" in relation to the frame member and "$0,5n\times V_1$" in relation to the ground where "n" is the number of the supporting members.

40. An apparatus for constructing an underground curvilinear and horizontally extending structure in a trench being formed in the ground that includes large and mainly ball-shaped boulders, the apparatus comprises:

a chassis supporting a means for forming the structure and supplying power and materials to the structure-forming means, the chassis being movable along the length of a structure line;

a connecting framework mounted on the chassis and adapted to connect the forming means to the chassis and to dispose and advance the forming means in an intended advancing direction;

the forming means comprising an elongate blade-shaped frame for supporting components of the forming means, a means for making excavate sections to excavate sections ahead of the frame and for steering the apparatus, that is securely mounted to an underground portion of the frame, and is able to force the chassis with the frame from its position toward the intended advancing direction and control the direction of the advancement of the trench and the apparatus as the apparatus advances across the ground, the forming and steering means is selected from groups consisting of the framework, drive wheels and tracks of the chassis, and being adapted to be disposed in working positions and extended into the ground up to a predetermined depth and distance toward and in the intended advancing direction to excavate, form and support the side walls of an excavated section being formed along the length of the line to lay the structure materials into the excavated section and to steering the apparatus.

41. The apparatus according to claim 40, additionally including a means for measuring the position, shape, and dimensions of buried boulders the apparatus comes across and determining when to operate multiple activating means of the apparatus to effect further advancement of the section.

* * * * *